US012031533B2

(12) United States Patent
Noh

(10) Patent No.: US 12,031,533 B2
(45) Date of Patent: Jul. 9, 2024

(54) LINEAR COMPRESSOR

(71) Applicant: LG ELECTRONICS INC., Seoul (KR)

(72) Inventor: Kiwon Noh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/874,737

(22) Filed: Jul. 27, 2022

(65) Prior Publication Data

US 2023/0193890 A1 Jun. 22, 2023

(30) Foreign Application Priority Data

Dec. 20, 2021 (KR) ..... 10-2021-0183053

(51) Int. Cl.

| | |
|---|---|
| ***F04B 39/12*** | (2006.01) |
| ***F04B 35/04*** | (2006.01) |
| ***F04B 39/00*** | (2006.01) |
| ***F04B 53/00*** | (2006.01) |

(52) U.S. Cl.

CPC ..... *F04B 39/123* (2013.01); *F04B 39/0061* (2013.01); *F04B 53/004* (2013.01); *F04B 35/045* (2013.01); *F04B 39/0066* (2013.01)

(58) Field of Classification Search

CPC ..... F04B 39/0027; F04B 39/0061; F04B 39/123; F04B 53/004; F04B 35/045; F04B 39/0055; F04B 39/0066

See application file for complete search history.

(56) References Cited

U.S. PATENT DOCUMENTS

2015/0004014 A1* 1/2015 Kim ..... F04B 35/045 417/312
2015/0226191 A1* 8/2015 Ki ..... F04B 39/16 417/559
2016/0003253 A1* 1/2016 Lee ..... F04B 39/0027 417/420

FOREIGN PATENT DOCUMENTS

| | | |
|---|---|---|
| EP | 2960505 | 12/2015 |
| EP | 3196460 | 7/2017 |
| EP | 3587812 | 1/2020 |
| EP | 3812584 | 4/2021 |
| KR | 10-2010-0112473 | 10/2010 |
| KR | 101484324 | 1/2015 |
| KR | 10-2016-0001056 | 1/2016 |

(Continued)

OTHER PUBLICATIONS

Office Action in Korean Appln. No. 10-2021-0183053, dated Apr. 10, 2023, 16 pages (with English translation).

(Continued)

*Primary Examiner* — Charles G Freay
*Assistant Examiner* — David N Brandt
(74) *Attorney, Agent, or Firm* — Fish & Richardson P.C.

(57) ABSTRACT

A linear compressor includes a casing, a back cover supported in the casing, an intake flow path member coupled to the back cover, and an intake muffler of which at least a portion linearly reciprocates inside the intake flow path member. The intake flow path member includes a first hole that is formed in a front surface and is penetrated by the intake muffler, and a flow path guide that extends axially forward from a rear surface and has an opened front and an opened rear. A noise of a refrigerant passing through the intake flow path member can be reduced through an expansion space between the flow path guide and an inner surface of the intake flow path member.

14 Claims, 17 Drawing Sheets

(56) References Cited

FOREIGN PATENT DOCUMENTS

| | | |
|---|---|---|
| KR | 10-2017-0124909 | 11/2017 |
| KR | 10-2018-0083075 | 7/2018 |
| KR | 10-2021-0039345 | 4/2021 |

OTHER PUBLICATIONS

Extended European Search Report in European Appln. No. 22190940.
1, dated Jan. 2, 2023, 7 pages.

* cited by examiner

LINEAR COMPRESSOR

CROSS-REFERENCE TO RELATED APPLICATIONS

This application claims the benefit of Korea Patent Application No. 10-2021-0183053, filed on Dec. 20, 2021, which is incorporated herein by reference for all purposes as if fully set forth herein.

TECHNICAL FIELD

The present disclosure relates to a compressor. More specifically, the present disclosure relates to a linear compressor for compressing a refrigerant by a linear reciprocating motion of a piston.

BACKGROUND

In general, a compressor refers to a device that is configured to receive power from a power generator such as a motor or a turbine and compress a working fluid such as air or a refrigerant. More specifically, the compressors are widely used in the whole industry or home appliances, especially a steam compression refrigeration cycle (hereinafter, referred to as "refrigeration cycle").

The compressors may be classified into a reciprocating compressor, a rotary compressor, and a scroll compressor according to a method of compressing the refrigerant.

The reciprocating compressor uses a method in which a compression space is formed between a piston and a cylinder, and the piston linearly reciprocates to compress a fluid. The rotary compressor uses a method of compressing a fluid by a roller that eccentrically rotates inside a cylinder. The scroll compressor uses a method of compressing a fluid by engaging and rotating a pair of spiral scrolls.

Recently, among the reciprocating compressors, the use of linear compressors that uses a linear reciprocating motion without using a crank shaft is gradually increasing. The linear compressor has advantages in that it has less mechanical loss resulting from switching a rotary motion to the linear reciprocating motion and thus can improve the efficiency, and has a relatively simple structure.

The linear compressor is configured such that a cylinder is positioned in a casing forming a sealed space to form a compression chamber, and a piston covering the compression chamber reciprocates inside the cylinder. The linear compressor repeats a process in which a fluid in the sealed space is suctioned into the compression chamber while the piston is positioned at a bottom dead center (BDC), and the fluid of the compression chamber is compressed and discharged while the piston is positioned at a top dead center (TDC).

A compression unit and a drive unit are installed inside the linear compressor. The compression unit performs a process of compressing and discharging a refrigerant while performing a resonant motion by a resonant spring through a movement generated in the drive unit.

The piston of the linear compressor repeatedly performs a series of processes of suctioning the refrigerant into the casing through a suction pipe while reciprocating at high speed inside the cylinder by the resonant spring, and then discharging the refrigerant from a compression space through a forward movement of the piston to move it to a condenser through a discharge pipe.

The linear compressor may be classified into an oil lubricated linear compressor and a gas lubricated linear compressor according to a lubrication method.

The oil lubricated linear compressor is configured to store a predetermined amount of oil in the casing and lubricate between the cylinder and the piston using the oil.

On the other hand, the gas lubricated linear compressor is configured not to store an oil in the casing, induce a part of the refrigerant discharged from the compression space between the cylinder and the piston, and lubricate between the cylinder and the piston by a gas force of the refrigerant.

The oil lubricated linear compressor supplies the oil of a relatively low temperature between the cylinder and the piston and thus can suppress the cylinder and the piston from being overheated by motor heat or compression heat, etc. Hence, the oil lubricated linear compressor suppresses specific volume from increasing as the refrigerant passing through a suction flow path of the piston is suctioned into the compression chamber of the cylinder and is heated, and thus can prevent in advance a suction loss from occurring.

However, when the refrigerant and an oil discharged to a refrigeration cycle device are not smoothly returned to the compressor, the oil lubricated linear compressor may experience an oil shortage inside the casing of the compressor. The oil shortage inside the casing may lead to a reduction in the reliability of the compressor.

On the other hand, because the gas lubricated linear compressor can be made smaller than the oil lubricated linear compressor and lubricate between the cylinder and the piston using the refrigerant, the gas lubricated linear compressor has an advantage in that there is no reduction in the reliability of the compressor due to the oil shortage.

FIG. 16 is a cross-sectional perspective view of a partial configuration of a linear compressor according to a related art.

Referring to FIG. 16, a linear compressor according to a related art is configured such that a refrigerant introduced in an intake pipe 114 coupled to a shell cover 112 of a casing is introduced into an intake muffler 160 through a guide member 900 coupled to a back cover 123 via an intake guide 116*a*.

FIG. 17 is a cross-sectional view of a partial configuration of a linear compressor according to a related art.

In the linear compressor according to the related art, a high-temperature refrigerant f1 between an inner surface of a side surface 1122 connected to a rear surface 1124 of the shell cover 112 and the back cover 123 is introduced in a space between the intake guide 116*a* and the back cover 123 and increases a temperature of a low-temperature suction refrigerant. In this case, there was a problem in that compression efficiency of the linear compressor is reduced.

FIGS. 18 and 19 illustrate a fluid flow during an operation of a linear compressor according to a related art.

When a piston 150 linearly reciprocates in an axial direction, a high-temperature refrigerant outside the intake muffler 160 coupled to the piston 150 is introduced in a space between the intake muffler 160 and the guide member 900 and increases a temperature of a suction refrigerant. In this case, there was a problem in that compression efficiency of the linear compressor is reduced.

When the intake muffler 160 coupled to the piston 150 linearly reciprocates in the axial direction, there was a problem in that a refrigerant f2 causing a backflow in an expansion space of the intake muffler 160 interferes with the suction refrigerant and blocks the flow of the suction refrigerant.

SUMMARY

An object of the present disclosure is to provide a linear compressor capable of reducing a noise generated by a suction refrigerant.

Another object of the present disclosure is to provide a linear compressor capable of minimizing a pressure loss due to an expansion of a suction refrigerant while reducing a noise.

Another object of the present disclosure is to provide a linear compressor capable of reducing interference with a suction refrigerant by reducing an amount of a refrigerant flowing back from an intake muffler.

Another object of the present disclosure is to provide a linear compressor capable of preventing a refrigerant outside an intake muffler from flowing back through a space between an intake flow path member and the intake muffler.

Another object of the present disclosure is to provide a linear compressor capable of increasing an efficiency of preventing a refrigerant outside an intake muffler from flowing back through a space between an intake flow path member and the intake muffler.

Another object of the present disclosure is to provide a linear compressor capable of preventing a refrigerant of a space between a rear surface of a back cover and a casing from being introduced into a space between an intake flow path member and an intake guide communicating with an intake pipe.

Another object of the present disclosure is to provide a linear compressor capable of preventing a refrigerant in front of a back cover from being introduced through a space between a radially outer surface of the back cover and an inner surface of a casing.

Another object of the present disclosure is to provide a linear compressor capable of preventing a collision of components due to a vibration generated during an operation of the linear compressor while preventing a refrigerant in front of a back cover from being introduced through a space between a radially outer surface of the back cover and an inner surface of a casing.

Another object of the present disclosure is to provide a linear compressor capable of preventing a refrigerant of a space between a rear surface of a heat blocking member and a casing from being introduced into a space between an intake flow path member and an intake guide communicating with an intake pipe.

Another object of the present disclosure is to provide a linear compressor capable of preventing a suction refrigerant introduced through an intake guide from being dissipated to the outside of an intake flow path member.

Another object of the present disclosure is to provide a linear compressor capable of coupling a back cover, a support spring, and an intake flow path member even without a separate process such as adhesion.

Another object of the present disclosure is to provide a linear compressor capable of preventing a reduction in an amount of a suction refrigerant by guiding a suction refrigerant, that is dissipated to the outside of an intake flow path member among a suction refrigerant introduced through an intake guide, to the inside of the intake flow path member.

Another object of the present disclosure is to provide a linear compressor capable of coupling a back cover, a support spring, an intake flow path member, and a heat blocking member even without a separate process such as adhesion.

To achieve the above-described and other objects, in one aspect of the present disclosure, there is provided a linear compressor comprising a casing, a back cover supported in the casing, an intake flow path member coupled to the back cover, and an intake muffler of which at least a portion linearly reciprocates inside the intake flow path member.

In this case, the intake flow path member may comprise a first hole that is formed in a front surface of the intake flow path member and is penetrated by the intake muffler, and a flow path guide that extends axially forward from a rear surface of the intake flow path member and has an opened front and an opened rear.

A noise of a refrigerant passing through the intake flow path member can be reduced through an expansion space between the flow path guide and an inner surface of the intake flow path member. In this case, the present disclosure can prevent a compression loss of the linear compressor by minimizing a pressure loss due to an expansion of a suction refrigerant through the flow path guide.

The flow path guide may comprise a plurality of holes that is spaced apart from each other and communicates an inside of the flow path guide with a space between the flow path guide and an inner surface of the intake flow path member.

Hence, the present disclosure can reduce interference with a suction refrigerant by reducing an amount of a refrigerant flowing back from the intake muffler, thereby preventing a loss of the suction refrigerant.

The flow path guide may be disposed inside the intake flow path member, and a diameter of the flow path guide may be greater than a diameter of the first hole.

The intake flow path member may comprise a partition wall disposed at an axially rear of the front surface of the intake flow path member and having a second hole penetrated by the intake muffler.

Hence, the present disclosure can prevent a refrigerant outside the intake muffler from flowing back through a space between the intake flow path member and the intake muffler.

A diameter of the second hole may be less than a diameter of the first hole.

Hence, the present disclosure can increase an efficiency of preventing a refrigerant outside the intake muffler from flowing back through a space between the intake flow path member and the intake muffler.

An axially rear end of the flow path guide may extend axially rearward from the rear surface of the intake flow path member and may protrude by passing through a third hole formed in a central area of the back cover.

Hence, the present disclosure can prevent a refrigerant of a space between a rear surface of the back cover and the casing from being introduced into a space between the intake flow path member and the intake guide communicating with the intake pipe.

The linear compressor may further comprise a heat blocking member coupled to a rear surface of the back cover and protruding radially outward further than the back cover.

Hence, the present disclosure can prevent a refrigerant in front of the back cover from being introduced through a space between a radially outer surface of the back cover and an inner surface of the casing.

An outer surface of the heat blocking member may be disposed adjacent to an inner surface of the casing.

Hence, the present disclosure can prevent a collision of components due to a vibration generated during an operation of the linear compressor while preventing a refrigerant in front of the back cover from being introduced through a space between a radially outer surface of the back cover and an inner surface of the casing.

An axially rear end of the flow path guide may extend axially rearward from the rear surface of the intake flow path member and may protrude by passing through a fourth hole formed in a central area of the heat blocking member.

Hence, the present disclosure can prevent a refrigerant of a space between the rear surface of the heat blocking member and the casing from being introduced into a space between the intake flow path member and the intake guide communicating with the intake pipe.

The linear compressor may further comprise an intake guide communicating with an intake pipe that is coupled to the casing and suctions a refrigerant from an outside. A diameter of the flow path guide may be greater than a diameter of the intake guide.

Hence, the present disclosure can prevent a suction refrigerant introduced through the intake guide from being dissipated to the outside of the intake flow path member.

The linear compressor may further comprise a support spring comprising an inner portion connected to the intake guide, an outer portion connected to the back cover, and a connection portion connecting the inner portion and the outer portion. The intake flow path member may comprise an extension extending radially outward from the rear surface of the intake flow path member, and the outer portion of the support spring, the extension, and the back cover may be coupled by a fastening member.

Hence, the present disclosure can couple the back cover, the support spring, and the intake flow path member even without a separate process such as adhesion.

The back cover may comprise a third hole that is formed in a central area and is penetrated by the flow path guide, and a plurality of fifth holes that is disposed radially outward further than the third hole and is spaced apart from each other in a circumferential direction. The plurality of fifth holes may communicate with a space between an inner surface of the intake flow path member and the flow path guide.

Hence, the present disclosure can prevent a reduction in an amount of a suction refrigerant by guiding a suction refrigerant, that is dissipated to the outside of the intake flow path member among a suction refrigerant introduced through the intake guide, to the inside of the intake flow path member.

To achieve the above-described and other objects, in another aspect of the present disclosure, there is provided a linear compressor comprising a casing, a back cover supported in the casing, an intake flow path member coupled to the back cover, an intake muffler of which at least a portion linearly reciprocates inside the intake flow path member, and a heat blocking member coupled to a rear surface of the back cover and protruding radially outward further than the back cover.

Hence, the present disclosure can prevent a refrigerant in front of the back cover from being introduced through a space between a radially outer surface of the back cover and an inner surface of the casing.

An outer surface of the heat blocking member may be disposed adjacent to an inner surface of the casing.

Hence, the present disclosure can prevent a collision of components due to a vibration generated during an operation of the linear compressor while preventing a refrigerant in front of the back cover from being introduced through a space between a radially outer surface of the back cover and an inner surface of the casing.

The linear compressor may further comprise an intake guide communicating with an intake pipe that is coupled to the casing and suctions a refrigerant from an outside. The heat blocking member may comprise a fourth hole formed in a central area of the heat blocking member, and a diameter of the fourth hole may be greater than a diameter of the intake guide.

Hence, the present disclosure can prevent a suction refrigerant introduced through the intake guide from being dissipated to the outside of the intake flow path member.

The linear compressor may further comprise a support spring comprising an inner portion connected to the intake guide, an outer portion connected to the back cover, and a connection portion connecting the inner portion and the outer portion. The intake flow path member may comprise an extension extending radially outward from a rear surface of the intake flow path member. The outer portion of the support spring, the extension, the back cover, and the heat blocking member may be coupled by a fastening member.

Hence, the present disclosure can couple the back cover, the support spring, the intake flow path member, and the heat blocking member even without a separate process such as adhesion.

The intake flow path member may comprise a first hole that is formed in a front surface of the intake flow path member and is penetrated by the intake muffler, and a flow path guide that protrudes axially forward from a rear surface of the intake flow path member and has an opened front and an opened rear.

An outer diameter of the flow path guide may be less than a diameter of the first hole.

Based on the intake muffler moving rearward, a front area of the flow path guide may be disposed inside the intake muffler.

Hence, the present disclosure can prevent a refrigerant outside the intake muffler from flowing back through a space between the intake flow path member and the intake muffler.

The intake flow path member may comprise a first hole that is formed in a front surface of the intake flow path member and is penetrated by the intake muffler, and a flow path guide that protrudes axially rearward from a central area of a rear surface of the intake flow path member and has an opened front and an opened rear.

According to an embodiment, the present disclosure can provide a linear compressor capable of reducing a noise generated by a suction refrigerant.

According to an embodiment, the present disclosure can provide a linear compressor capable of minimizing a pressure loss due to an expansion of a suction refrigerant while reducing a noise.

According to an embodiment, the present disclosure can provide a linear compressor capable of reducing interference with a suction refrigerant by reducing an amount of a refrigerant flowing back from an intake muffler.

According to an embodiment, the present disclosure can provide a linear compressor capable of preventing a refrigerant outside an intake muffler from flowing back through a space between an intake flow path member and the intake muffler.

According to an embodiment, the present disclosure can provide a linear compressor capable of increasing an efficiency of preventing a refrigerant outside an intake muffler from flowing back through a space between an intake flow path member and the intake muffler.

According to an embodiment, the present disclosure can provide a linear compressor capable of preventing a refrigerant of a space between a rear surface of a back cover and a casing from being introduced into a space between an intake flow path member and an intake guide communicating with an intake pipe.

According to an embodiment, the present disclosure can provide a linear compressor capable of preventing a refrigerant in front of a back cover from being introduced through a space between a radially outer surface of the back cover and an inner surface of a casing.

According to an embodiment, the present disclosure can provide a linear compressor capable of preventing a collision of components due to a vibration generated during the operation of the linear compressor while preventing a refrigerant in front of a back cover from being introduced through a space between a radially outer surface of the back cover and an inner surface of a casing.

According to an embodiment, the present disclosure can provide a linear compressor capable of preventing a refrigerant of a space between a rear surface of a heat blocking member and a casing from being introduced into a space between an intake flow path member and an intake guide communicating with an intake pipe.

According to an embodiment, the present disclosure can provide a linear compressor capable of preventing a suction refrigerant introduced through an intake guide from being dissipated to the outside of an intake flow path member.

According to an embodiment, the present disclosure can provide a linear compressor capable of coupling a back cover, a support spring, and an intake flow path member even without a separate process such as adhesion.

According to an embodiment, the present disclosure can provide a linear compressor capable of preventing a reduction in an amount of a suction refrigerant by guiding a suction refrigerant, that is dissipated to the outside of an intake flow path member among a suction refrigerant introduced through an intake guide, to the inside of the intake flow path member.

According to an embodiment, the present disclosure can provide a linear compressor capable of coupling a back cover, a support spring, an intake flow path member, and a heat blocking member even without a separate process such as adhesion.

BRIEF DESCRIPTION OF THE DRAWINGS

The accompanying drawings, which are included to provide a further understanding of the present disclosure and constitute a part of the detailed description, illustrate embodiments of the present disclosure and serve to explain technical features of the present disclosure together with the description.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts.

In embodiments of the disclosure, when an arbitrary component is described as "being connected to" or "being coupled to" other component, it should be understood that another component(s) may exist between them, although the arbitrary component may be directly connected or coupled to the other component.

It will be noted that a detailed description of known arts will be omitted if it is determined that the detailed description of the known arts can obscure embodiments of the disclosure. The accompanying drawings are used to help easily understand various technical features and it should be understood that embodiments presented herein are not limited by the accompanying drawings. As such, the present disclosure should be understand to extend to any alterations, equivalents and substitutes in addition to those which are particularly set out in the accompanying drawings.

In addition, a term of "disclosure" may be replaced by document, specification, description, etc.

Figure 1:
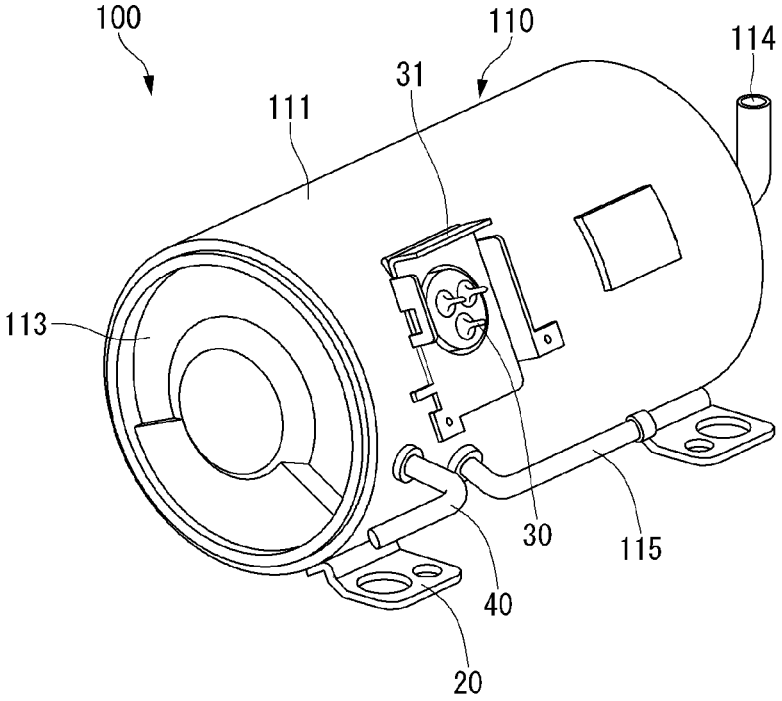
FIG. 1 is a perspective view of a linear compressor according to an embodiment of the disclosure.

FIG. 1 is a perspective view of a linear compressor according to an embodiment of the disclosure.

Referring to FIG. 1, a linear compressor 100 according to an embodiment of the disclosure may include a shell 111 and shell covers 112 and 113 coupled to the shell 111. In a broad sense, the shell covers 112 and 113 can be understood as one configuration of the shell 111.

Legs 20 may be coupled to a lower side of the shell 111. The legs 20 may be coupled to a base of a product on which the linear compressor 100 is mounted. For example, the product may include a refrigerator, and the base may include a machine room base of the refrigerator. As another example, the product may include an outdoor unit of an air conditioner, and the base may include a base of the outdoor unit.

The shell 111 may have a substantially cylindrical shape and may be disposed to lie in a horizontal direction or an axial direction. FIG. 1 illustrates that the shell 111 is extended in the horizontal direction and has a slightly low height in a radial direction, by way of example. That is, since the linear compressor 100 can have a low height, there is an advantage in that a height of the machine room can decrease when the linear compressor 100 is installed in, for example, the machine room base of the refrigerator.

A longitudinal central axis of the shell 111 coincides with a central axis of a main body of the compressor 100 to be described later, and the central axis of the main body of the compressor 100 coincides with a central axis of a cylinder 140 and a piston 150 constituting the main body of the compressor 100.

A terminal 30 may be installed on an external surface of the shell 111. The terminal 30 may transmit external electric power to a drive unit 130 of the linear compressor 100. More specifically, the terminal 30 may be connected to a lead line of a coil 132*b*.

A bracket 31 may be installed on the outside of the terminal 30. The bracket 31 may include a plurality of brackets surrounding the terminal 30. The bracket 31 may perform a function of protecting the terminal 30 from an external impact, etc.

Both sides of the shell 111 may be opened. The shell covers 112 and 113 may be coupled to both sides of the opened shell 111. More specifically, the shell covers 112 and 113 may include a first shell cover 112 coupled to one opened side of the shell 111 and a second shell cover 113 coupled to the other opened side of the shell 111. An inner space of the shell 111 may be closed by the shell covers 112 and 113.

FIG. 1 illustrates that the first shell cover 112 is positioned on the right side of the linear compressor 100, and the second shell cover 113 is positioned on the left side of the linear compressor 100, by way of example. In other words, the first and second shell covers 112 and 113 may be disposed to face each other. It can be understood that the first shell cover 112 is positioned on a suction side of a refrigerant, and the second shell cover 113 is positioned on a discharge side of the refrigerant.

The linear compressor 100 may include a plurality of pipes 114, 115, and 40 that is included in the shell 111 or the shell covers 112 and 113 and can suction, discharge, or inject the refrigerant.

The plurality of pipes 114, 115, and 40 may include a suction pipe 114 that allows the refrigerant to be suctioned into the linear compressor 100, a discharge pipe 115 that allows the compressed refrigerant to be discharged from the linear compressor 100, and a supplementary pipe 40 for supplementing the refrigerant in the linear compressor 100.

For example, the suction pipe 114 may be coupled to the first shell cover 112. The refrigerant may be suctioned into the linear compressor 100 along the axial direction through the suction pipe 114.

The discharge pipe 115 may be coupled to an outer circumferential surface of the shell 111. The refrigerant suctioned through the suction pipe 114 may be compressed while flowing in the axial direction. The compressed refrigerant may be discharged through the discharge pipe 115. The discharge pipe 115 may be disposed closer to the second shell cover 113 than to the first shell cover 112.

The supplementary pipe 40 may be coupled to the outer circumferential surface of the shell 111. A worker may inject the refrigerant into the linear compressor 100 through the supplementary pipe 40.

The supplementary pipe 40 may be coupled to the shell 111 at a different height from the discharge pipe 115 in order to prevent interference with the discharge pipe 115. Here, the height may be understood as a distance measured from the leg 20 in a vertical direction. Because the discharge pipe 115 and the supplementary pipe 40 are coupled to the outer circumferential surface of the shell 111 at different heights, the work convenience can be attained.

On an inner circumferential surface of the shell 111 corresponding to a location at which the supplementary pipe 40 is coupled, at least a portion of the second shell cover 113 may be positioned adjacently. In other words, at least a portion of the second shell cover 113 may act as a resistance of the refrigerant injected through the supplementary pipe 40.

Thus, with respect to a flow path of the refrigerant, a size of the flow path of the refrigerant introduced through the supplementary pipe 40 is configured to decrease by the second shell cover 113 while the refrigerant enters into the inner space of the shell 111, and again increase while the refrigerant passes through the second shell cover 113. In this process, a pressure of the refrigerant may be reduced to vaporize the refrigerant, and an oil contained in the refrigerant may be separated. Thus, while the refrigerant, from which the oil is separated, is introduced into the piston 150, a compression performance of the refrigerant can be improved. The oil may be understood as a working oil present in a cooling system.

Figure 2:
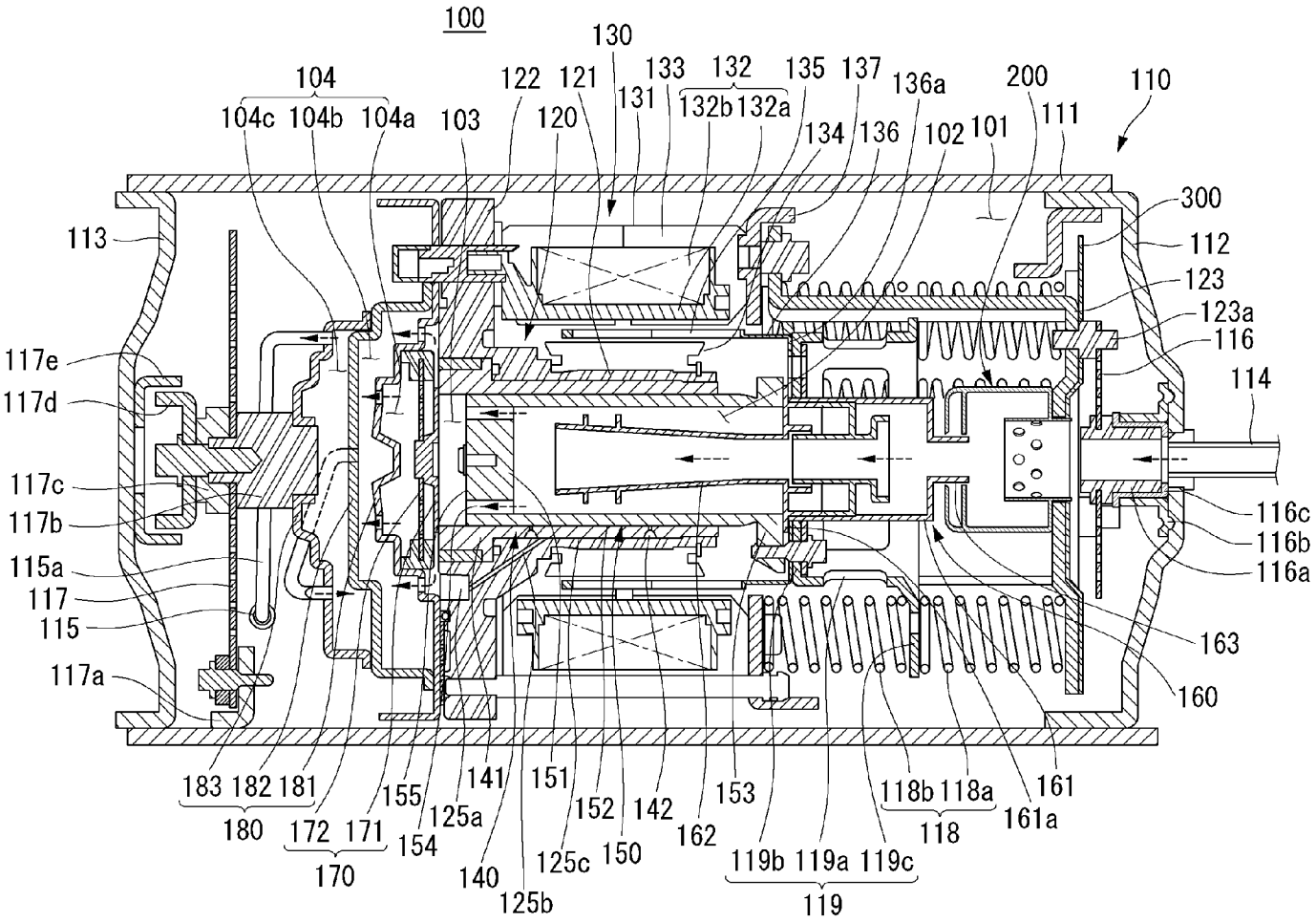
FIG. 2 is a cross-sectional view of a linear compressor according to an embodiment of the disclosure.

FIG. 2 is a cross-sectional view of a linear compressor according to an embodiment of the disclosure.

Hereinafter, a linear compressor according to the present disclosure will be described taking, as an example, a linear compressor that suctions and compresses a fluid while a piston linearly reciprocates, and discharges the compressed fluid.

The linear compressor may be a component of a refrigeration cycle, and the fluid compressed in the linear compressor may be a refrigerant circulating the refrigeration cycle. The refrigeration cycle may include a condenser, an expander, an evaporator, etc., in addition to the compressor. The linear compressor may be used as a component of the cooling system of the refrigerator, but is not limited thereto. The linear compressor can be widely used in the whole industry.

Referring to FIG. 2, the compressor 100 may include a casing 110 and a main body accommodated in the casing 110. The main body of the compressor 100 may include a frame 120, the cylinder 140 fixed to the frame 120, the piston 150 that linearly reciprocates inside the cylinder 140, the drive unit 130 that is fixed to the frame 120 and gives a driving force to the piston 150, and the like. Here, the cylinder 140 and the piston 150 may be referred to as compression units 140 and 150.

The compressor 100 may include a bearing means for reducing a friction between the cylinder 140 and the piston 150. The bearing means may be an oil bearing or a gas bearing. Alternatively, a mechanical bearing may be used as the bearing means.

The main body of the compressor 100 may be elastically supported by support springs 116 and 117 installed at both ends inside the casing 110. The support springs 116 and 117 may include a first support spring 116 for supporting the rear of the main body and a second support spring 117 for supporting the front of the main body. The support springs 116 and 117 may include a leaf spring. The support springs 116 and 117 can absorb vibrations and impacts generated by a reciprocating motion of the piston 150 while supporting the internal parts of the main body of the compressor 100.

The casing 110 may form a sealed space. The sealed space may include an accommodation space 101 in which the suctioned refrigerant is accommodated, a suction space 102 which is filled with the refrigerant before the compression, a compression space 103 in which the refrigerant is compressed, and a discharge space 104 which is filled with the compressed refrigerant.

The refrigerant suctioned from the suction pipe 114 connected to the rear side of the casing 110 may be filled in the accommodation space 101, and the refrigerant in the suction space 102 communicating with the accommodation space 101 may be compressed in the compression space 103, discharged to the discharge space 104, and discharged to the outside through the discharge pipe 115 connected to the front side of the casing 110.

The casing 110 may include the shell 111 formed in a substantially cylindrical shape that is open at both ends and is long in a transverse direction, the first shell cover 112 coupled to the rear side of the shell 111, and the second shell cover 113 coupled to the front side of the shell 111. Here, it can be understood that the front side is the left side of the figure and is a direction in which the compressed refrigerant is discharged, and the rear side is the right side of the figure and is a direction in which the refrigerant is introduced. Further, the first shell cover 112 and the second shell cover 113 may be formed as one body with the shell 11.

The casing 110 may be formed of a thermally conductive material. Hence, heat generated in the inner space of the casing 110 can be quickly dissipated to the outside.

The first shell cover 112 may be coupled to the shell 111 in order to seal the rear of the shell 111, and the suction pipe 114 may be inserted and coupled to the center of the first shell cover 112.

The rear of the main body of the compressor 100 may be elastically supported by the first support spring 116 in the radial direction of the first shell cover 112.

The first support spring 116 may include a circular leaf spring. An edge of the first support spring 116 may be elastically supported by a support bracket 123*a* in a forward direction with respect to a back cover 123. An opened center portion of the first support spring 116 may be supported by a suction guide 116*a* in a rearward direction with respect to the first shell cover 112.

The suction guide 116*a* may have a through passage formed therein. The suction guide 116*a* may be formed in a cylindrical shape. A front outer circumferential surface of the suction guide 116*a* may be coupled to a central opening of the first support spring 116, and a rear end of the suction guide 116*a* may be supported by the first shell cover 112. In this instance, a separate suction side support member 116*b* may be interposed between the suction guide 116*a* and an inner surface of the first shell cover 112.

A rear side of the suction guide 116*a* may communicate with the suction pipe 114, and the refrigerant suctioned through the suction pipe 114 may pass through the suction guide 116*a* and may be smoothly introduced into a muffler unit 160 to be described later.

A damping member 116*c* may be disposed between the suction guide 116*a* and the suction side support member 116*b*. The damping member 116*c* may be formed of a rubber material or the like. Hence, a vibration that may occur in the process of suctioning the refrigerant through the suction pipe 114 can be prevented from being transmitted to the first shell cover 112.

The second shell cover 113 may be coupled to the shell 111 to seal the front side of the shell 111, and the discharge pipe 115 may be inserted and coupled through a loop pipe 115*a*. The refrigerant discharged from the compression space 103 may pass through a discharge cover assembly 180 and then may be discharged into the refrigeration cycle through the loop pipe 115*a* and the discharge pipe 115.

A front side of the main body of the compressor 100 may be elastically supported by the second support spring 117 in the radial direction of the shell 111 or the second shell cover 113.

The second support spring 117 may include a circular leaf spring. An opened center portion of the second support spring 117 may be supported by a first support guide 117*b* in a rearward direction with respect to the discharge cover assembly 180. An edge of the second support spring 117 may be supported by a support bracket 117*a* in a forward direction with respect to the inner surface of the shell 111 or the inner circumferential surface of the shell 111 adjacent to the second shell cover 113.

Unlike FIG. 2, the edge of the second support spring 117 may be supported in the forward direction with respect to the inner surface of the shell 111 or the inner circumferential surface of the shell 111 adjacent to the second shell cover 113 through a separate bracket (not shown) coupled to the second shell cover 113.

The first support guide 117*b* may be formed in a cylindrical shape. A cross section of the first support guide 117*b* may have a plurality of diameters. A front side of the first support guide 117*b* may be connected to the second support spring 117, and a rear side of the first support guide 117 may be inserted into a central opening of the discharge cover assembly 180. A support cover 117*c* may be coupled to the front side of the first support guide 117*b* with the second support spring 117 interposed therebetween. A cup-shaped second support guide 117*d* that is recessed forward may be coupled to the front side of the support cover 117*c*. A cup-shaped third support guide 117*e* that corresponds to the second support guide 117*d* and is recessed rearward may be coupled to the inside of the second shell cover 113. The second support guide 117*d* may be inserted into the third support guide 117*e* and may be supported in the axial direction and/or the radial direction. In this instance, a gap may be formed between the second support guide 117*d* and the third support guide 117*e*.

The frame 120 may include a body portion 121 supporting the outer circumferential surface of the cylinder 140, and a first flange portion 122 that is connected to one side of the body portion 121 and supports the drive unit 130. The frame 120 may be elastically supported with respect to the casing 110 by the first and second support springs 116 and 117 together with the drive unit 130 and the cylinder 140.

The body portion 121 may wrap the outer circumferential surface of the cylinder 140. The body portion 121 may be formed in a cylindrical shape. The first flange portion 122 may extend from a front end of the body portion 121 in the radial direction.

The cylinder 140 may be coupled to an inner circumferential surface of the body portion 121. An inner stator 134 may be coupled to an outer circumferential surface of the body portion 121. For example, the cylinder 140 may be pressed and fitted to the inner circumferential surface of the body portion 121, and the inner stator 134 may be fixed using a separate fixing ring (not shown).

An outer stator 131 may be coupled to a rear surface of the first flange portion 122, and the discharge cover assembly 180 may be coupled to a front surface of the first flange portion 122. For example, the outer stator 131 and the discharge cover assembly 180 may be fixed through a mechanical coupling means.

On one side of the front surface of the first flange portion 122, a bearing inlet groove 125*a* forming a part of the gas bearing may be formed, a bearing communication hole 125*b* penetrating from the bearing inlet groove 125*a* to the inner circumferential surface of the body portion 121 may be formed, and a gas groove 125*c* communicating with the bearing communication hole 125*b* may be formed on the inner circumferential surface of the body portion 121.

The bearing inlet groove 125*a* may be recessed to a predetermined depth in the axial direction. The bearing communication hole 125*b* is a hole having a smaller cross-sectional area than the bearing inlet groove 125*a* and may be inclined toward the inner circumferential surface or the inside surface of the body portion 121. The gas groove 125*c* may be formed in an annular shape having a predetermined depth and an axial length on the inner circumferential surface of the body portion 121. Alternatively, the gas groove 125*c* may be formed on the outer circumferential surface of the cylinder 140 in contact with the inner circumferential surface of the body portion 121, or formed on both the inner circumferential surface of the body portion 121 and the outer circumferential surface of the cylinder 140.

In addition, a gas inlet 142 corresponding to the gas groove 125*c* may be formed on the outer circumferential surface of the cylinder 140. The gas inlet 142 forms a kind of nozzle in the gas bearing.

The frame 120 and the cylinder 140 may be formed of aluminum or an aluminum alloy material.

The cylinder 140 may be formed in a cylindrical shape that is open at both ends. The piston 150 may be inserted through a rear end of the cylinder 140. A front end of the cylinder 140 may be closed via a discharge valve assembly 170. The compression space 103 may be formed between the cylinder 140, a front end of the piston 150, and the discharge valve assembly 170. Here, the front end of the piston 150 may be referred to as a head portion 151. The compression space 103 increases in volume when the piston 150 moves backward, and decreases in volume as the piston 150 moves forward. That is, the refrigerant introduced into the compression space 103 may be compressed while the piston 150 moves forward, and may be discharged through the discharge valve assembly 170.

The cylinder 140 may include a second flange portion 141 disposed at the front end. The second flange portion 141 may bend to the outside of the cylinder 140. The second flange portion 141 may extend in an outer circumferential direction of the cylinder 140. The second flange portion 141 of the cylinder 140 may be coupled to the frame 120. For example, the front end of the frame 120 may include a flange groove corresponding to the second flange portion 141 of the cylinder 140, and the second flange portion 141 of the cylinder 140 may be inserted into the flange groove and coupled through a coupling member.

A gas bearing means may be provided to supply a discharge gas to a gap between the outer circumferential surface of the piston 150 and the outer circumferential surface of the cylinder 140 and lubricate between the cylinder 140 and the piston 150 with gas. The discharge gas between the cylinder 140 and the piston 150 may provide a floating force to the piston 150 to reduce a friction generated between the piston 150 and the cylinder 140.

For example, the cylinder 140 may include the gas inlet 142. The gas inlet 142 may communicate with the gas groove 125*c* formed on the inner circumferential surface of the body portion 121. The gas inlet 142 may pass through the cylinder 140 in the radial direction. The gas inlet 142 may guide the compressed refrigerant introduced in the gas groove 125*c* between the inner circumferential surface of the cylinder 140 and the outer circumferential surface of the piston 150. Alternatively, the gas groove 125*c* may be formed on the outer circumferential surface of the cylinder 140 in consideration of the convenience of processing.

An entrance of the gas inlet 142 may be formed relatively widely, and an exit of the gas inlet 142 may be formed as a fine through hole to serve as a nozzle. The entrance of the gas inlet 142 may further include a filter (not shown) blocking the inflow of foreign matter. The filter may be a metal mesh filter, or may be formed by winding a member such as fine thread.

The plurality of gas inlets 142 may be independently formed. Alternatively, the entrance of the gas inlet 142 may be formed as an annular groove, and a plurality of exits may be formed along the annular groove at regular intervals. The gas inlet 142 may be formed only at the front side based on the axial middle of the cylinder 140. On the contrary, the gas inlet 142 may be formed at the rear side based on the axial middle of the cylinder 140 in consideration of the sagging of the piston 150.

The piston 150 is inserted into the opened rear end of the cylinder 140 and is provided to seal the rear of the compression space 103.

The piston 150 may include a head 151 and a guide 152. The head 151 may be formed in a disc shape. The head 151 may be partially open. The head 151 may partition the compression space 103. The guide 152 may extend rearward from an outer circumferential surface of the head 151. The guide 152 may be formed in a cylindrical shape. The inside of the guide 152 may be empty, and the front of the guide 152 may be partially sealed by the head 151. The rear of the guide 152 may be opened and connected to the muffler unit 160. The head 151 may be provided as a separate member coupled to the guide 152. Alternatively, the head 151 and the guide 152 may be formed as one body.

The piston 150 may include a suction port 154. The suction port 154 may pass through the head 151. The suction port 154 may communicate with the suction space 102 and the compression space 103 inside the piston 150. For example, the refrigerant flowing from the accommodation space 101 to the suction space 102 inside the piston 150 may pass through the suction port 154 and may be suctioned into the compression space 103 between the piston 150 and the cylinder 140.

The suction port 154 may extend in the axial direction of the piston 150. The suction port 154 may be inclined in the axial direction of the piston 150. For example, the suction port 154 may extend to be inclined in a direction away from the central axis as it goes to the rear of the piston 150.

A cross section of the suction port 154 may be formed in a circular shape. The suction port 154 may have a constant inner diameter. In contrast, the suction port 154 may be formed as a long hole in which an opening extends in the radial direction of the head 151, or may be formed such that the inner diameter becomes larger as it goes to the rear.

The plurality of suction ports 154 may be formed in one or more of the radial direction and the circumferential direction of the head 151.

The head 151 of the piston 150 adjacent to the compression space 103 may be equipped with a suction valve 155 for selectively opening and closing the suction port 154. The suction valve 155 may operate by elastic deformation to open or close the suction port 154. That is, the suction valve 155 may be elastically deformed to open the suction port 154 by the pressure of the refrigerant flowing into the compression space 103 through the suction port 154. The suction valve 155 may be a lead valve, but is not limited thereto and may be variously changed.

The piston 150 may be connected to a mover 135. The mover 135 may reciprocate forward and backward according to the movement of the piston 150. The inner stator 134 and the cylinder 140 may be disposed between the mover 135 and the piston 150. The mover 135 and the piston 150 may be connected to each other by a magnet frame 136 that is formed by detouring the cylinder 140 and the inner stator 134 to the rear.

The muffler unit 160 may be coupled to the rear of the piston 150 to reduce a noise generated in the process of suctioning the refrigerant into the piston 150. The refrigerant suctioned through the suction pipe 114 may flow into the suction space 102 inside the piston 150 via the muffler unit 160.

The muffler unit 160 may include a suction muffler 161 communicating with the accommodation space 101 of the casing 110, and an inner guide 162 that is connected to the front of the suction muffler 161 and guides the refrigerant to the suction port 154.

The suction muffler 161 may be positioned in the rear of the piston 150. A rear opening of the suction muffler 161 may be disposed adjacent to the suction pipe 114, and a front end of the suction muffler 161 may be coupled to the rear of the piston 150. The suction muffler 161 may have a flow path formed in the axial direction to guide the refrigerant in the accommodation space 101 to the suction space 102 inside the piston 150.

The inside of the suction muffler 161 may include a plurality of noise spaces partitioned by a baffle. The suction muffler 161 may be formed by combining two or more members. For example, a second suction muffler may be press-coupled to the inside of a first suction muffler to form a plurality of noise spaces. In addition, the suction muffler 161 may be formed of a plastic material in consideration of weight or insulation property.

One side of the inner guide 162 may communicate with the noise space of the suction muffler 161, and other side may be deeply inserted into the piston 150. The inner guide 162 may be formed in a pipe shape. Both ends of the inner guide 162 may have the same inner diameter. The inner guide 162 may be formed in a cylindrical shape. Alternatively, an inner diameter of a front end that is a discharge side of the inner guide 162 may be greater than an inner diameter of a rear end opposite the front end.

The suction muffler 161 and the inner guide 162 may be provided in various shapes and may adjust the pressure of the refrigerant passing through the muffler unit 160. The suction muffler 161 and the inner guide 162 may be formed as one body.

The discharge valve assembly 170 may include a discharge valve 171 and a valve spring 172 that is provided on a front side of the discharge valve 171 to elastically support the discharge valve 171. The discharge valve assembly 170 may selectively discharge the compressed refrigerant in the compression space 103. Here, the compression space 103 means a space between the suction valve 155 and the discharge valve 171.

The discharge valve 171 may be disposed to be supportable on the front surface of the cylinder 140. The discharge valve 171 may selectively open and close the front opening of the cylinder 140. The discharge valve 171 may operate by elastic deformation to open or close the compression space 103. The discharge valve 171 may be elastically deformed to open the compression space 103 by the pressure of the refrigerant flowing into the discharge space 104 through the compression space 103. For example, the compression space 103 may maintain a sealed state while the discharge valve 171 is supported on the front surface of the cylinder 140, and the compressed refrigerant of the compression space 103 may be discharged to an opened space in a state where the discharge valve 171 is spaced apart from the front surface of the cylinder 140. The discharge valve 171 may be a lead valve, but is not limited thereto and may be variously changed.

The valve spring 172 may be provided between the discharge valve 171 and the discharge cover assembly 180 to provide an elastic force in the axial direction. The valve spring 172 may be provided as a compression coil spring, or may be provided as a leaf spring in consideration of an occupied space or reliability.

When the pressure of the compression space 103 is equal to or greater than a discharge pressure, the valve spring 172 may open the discharge valve 171 while deforming forward, and the refrigerant may be discharged from the compression space 103 and discharged to a first discharge space 104*a* of the discharge cover assembly 180. When the discharge of the refrigerant is completed, the valve spring 172 provides a restoring force to the discharge valve 171 and thus can allow the discharge valve 171 to be closed.

A process of introducing the refrigerant into the compression space 103 through the suction valve 155 and discharging the refrigerant of the compression space 103 to the discharge space 104 through the discharge valve 171 is described as follows.

In the process in which the piston 150 linearly reciprocates inside the cylinder 140, if the pressure of the compression space 103 is equal to or less than a predetermined suction pressure, the suction valve 155 is opened and thus the refrigerant is suctioned into a compression space 103. On the other hand, if the pressure of the compression space 103 exceeds the predetermined suction pressure, the refrigerant of the compression space 103 is compressed in a state in which the suction valve 155 is closed.

If the pressure of the compression space 103 is equal to or greater than the predetermined suction pressure, the valve spring 172 deforms forward and opens the discharge valve 171 connected to the valve spring 172, and the refrigerant is discharged from the compression space 103 to the discharge space 104 of the discharge cover assembly 180. When the discharge of the refrigerant is completed, the valve spring 172 provides a restoring force to the discharge valve 171 and allows the discharge valve 171 to be closed, thereby sealing the front of the compression space 103.

The discharge cover assembly 180 is installed in front of the compression space 103, forms a discharge space 104 for accommodating the refrigerant discharged from the compression space 103, and is coupled to the front of the frame 120 to thereby reduce a noise generated in the process of discharging the refrigerant from the compression space 103. The discharge cover assembly 180 may be coupled to the front of the first flange portion 122 of the frame 120 while accommodating the discharge valve assembly 170. For example, the discharge cover assembly 180 may be coupled to the first flange portion 122 through a mechanical coupling member.

An O-ring 166 may be provided between the discharge cover assembly 180 and the frame 120 to prevent the refrigerant in a gasket 165 for thermal insulation and the discharge space 104 from leaking.

The discharge cover assembly 180 may be formed of a thermally conductive material. Therefore, when a high temperature refrigerant is introduced into the discharge cover assembly 180, heat of the refrigerant may be transferred to the casing 110 through the discharge cover assembly 180 and dissipated to the outside of the compressor.

The discharge cover assembly 180 may include one discharge cover, or may be arranged so that a plurality of discharge covers sequentially communicates with each other. When the discharge cover assembly 180 is provided with the plurality of discharge covers, the discharge space 104 may include a plurality of spaces partitioned by the respective discharge covers. The plurality of spaces may be disposed in a front-rear direction and may communicate with each other.

For example, when there are three discharge covers, the discharge space 104 may include a first discharge space 104*a* between the frame 120 and a first discharge cover 181 coupled to the front side of the frame 120, a second discharge space 104*b* between the first discharge cover 181 and a second discharge cover 182 that communicates with the first discharge space 104*a* and is coupled to a front side of the first discharge cover 181, and a third discharge space 104*c* between the second discharge cover 182 and a third discharge cover 183 that communicates with the second discharge space 104*b* and is coupled to a front side of the second discharge cover 182.

The first discharge space 104*a* may selectively communicate with the compression space 103 by the discharge valve 171, the second discharge space 104*b* may communicate with the first discharge space 104*a*, and the third discharge space 104*c* may communicate with the second discharge space 104*b*. Hence, as the refrigerant discharged from the compression space 103 sequentially passes through the first discharge space 104*a*, the second discharge space 104*b*, and the third discharge space 104*c*, a discharge noise can be reduced, and the refrigerant can be discharged to the outside of the casing 110 through the loop pipe 115*a* and the discharge pipe 115 communicating with the third discharge cover 183.

The drive unit 130 may include the outer stator 131 that is disposed between the shell 111 and the frame 120 and surrounds the body portion 121 of the frame 120, the inner stator 134 that is disposed between the outer stator 131 and the cylinder 140 and surrounds the cylinder 140, and the mover 135 disposed between the outer stator 131 and the inner stator 134.

The outer stator 131 may be coupled to the rear of the first flange portion 122 of the frame 120, and the inner stator 134 may be coupled to the outer circumferential surface of the body portion 121 of the frame 120. The inner stator 134 may be spaced apart from the inside of the outer stator 131, and the mover 135 may be disposed in a space between the outer stator 131 and the inner stator 134.

The outer stator 131 may be equipped with a winding coil, and the mover 135 may include a permanent magnet. The permanent magnet may consist of a single magnet with one pole or configured by combining a plurality of magnets with three poles.

The outer stator 131 may include a coil winding 132 surrounding the axial direction in the circumferential direction and a stator core 133 stacked while surrounding the coil winding 132. The coil winding 132 may include a hollow cylindrical bobbin 132*a* and a coil 132*b* wound in a circumferential direction of the bobbin 132*a*. A cross section of the coil 132*b* may be formed in a circular or polygonal shape, for example, may have a hexagonal shape. In the stator core 133, a plurality of lamination sheets may be laminated radially, or a plurality of lamination blocks may be laminated along the circumferential direction.

The front side of the outer stator 131 may be supported by the first flange portion 122 of the frame 120, and the rear side thereof may be supported by a stator cover 137. For example, the stator cover 137 may be provided in a hollow disc shape, a front surface of the stator cover 137 may be supported by the outer stator 131, and a rear surface thereof may be supported by a resonant spring 118.

The inner stator 134 may be configured by stacking a plurality of laminations on the outer circumferential surface of the body portion 121 of the frame 120 in the circumferential direction.

One side of the mover 135 may be coupled to and supported by the magnet frame 136. The magnet frame 136 has a substantially cylindrical shape and may be disposed to be inserted into a space between the outer stator 131 and the inner stator 134. The magnet frame 136 may be coupled to the rear side of the piston 150 to move together with the piston 150.

As an example, a rear end of the magnet frame 136 is bent and extended inward in the radial direction to form a first coupling portion 136*a*, and the first coupling portion 136*a* may be coupled to a third flange portion 153 formed in the rear of the piston 150. The first coupling portion 136*a* of the magnet frame 136 and the third flange portion 153 of the piston 150 may be coupled through a mechanical coupling member.

A fourth flange portion 161*a* in front of the suction muffler 161 may be interposed between the third flange portion 153 of the piston 150 and the first coupling portion 136*a* of the magnet frame 136. Thus, the piston 150, the muffler unit 160, and the mover 135 can linearly reciprocate together in a combined state.

When a current is applied to the drive unit 130, a magnetic flux may be formed in the winding coil, and an electromagnetic force may occur by an interaction between the magnetic flux formed in the winding coil of the outer stator 131 and a magnetic flux formed by the permanent magnet of the mover 135 to move the mover 135. At the same time as the axial reciprocating movement of the mover 135, the piston 150 connected to the magnet frame 136 may also reciprocate integrally with the mover 135 in the axial direction.

The drive unit 130 and the compression units 140 and 150 may be supported by the support springs 116 and 117 and the resonant spring 118 in the axial direction.

The resonant spring 118 amplifies the vibration implemented by the reciprocating motion of the mover 135 and the piston 150 and thus can achieve an effective compression of the refrigerant. More specifically, the resonant spring 118 may be adjusted to a frequency corresponding to a natural frequency of the piston 150 to allow the piston 150 to perform a resonant motion. Further, the resonant spring 118 generates a stable movement of the piston 150 and thus can reduce the generation of vibration and noise.

The resonant spring 118 may be a coil spring extending in the axial direction. Both ends of the resonant spring 118 may be connected to a vibrating body and a fixed body, respectively. For example, one end of the resonant spring 118 may be connected to the magnet frame 136, and the other end may be connected to the back cover 123. Therefore, the resonant spring 118 may be elastically deformed between the vibrating body vibrating at one end and the fixed body fixed to the other end.

A natural frequency of the resonant spring 118 may be designed to match a resonant frequency of the mover 135 and the piston 150 during the operation of the compressor 100, thereby amplifying the reciprocating motion of the piston 150. However, because the back cover 123 provided as the fixing body is elastically supported by the first support spring 116 in the casing 110, the back cover 123 may not be strictly fixed.

The resonant spring 118 may include a first resonant spring 118*a* supported on the rear side and a second resonant spring 118*b* supported on the front side based on a spring supporter 119.

The spring supporter 119 may include a body portion 119*a* surrounding the suction muffler 161, a second coupling portion 119*b* that is bent from the front of the body portion 119*a* in the inward radial direction, and a support portion 119*c* that is bent from the rear of the body portion 119*a* in the outward radial direction.

A front surface of the second coupling portion 119*b* of the spring supporter 119 may be supported by the first coupling portion 136*a* of the magnet frame 136. An inner diameter of the second coupling portion 119*b* of the spring supporter 119 may cover an outer diameter of the suction muffler 161. For example, the second coupling portion 119*b* of the spring supporter 119, the first coupling portion 136*a* of the magnet frame 136, and the third flange portion 153 of the piston 150 may be sequentially disposed and then integrally coupled via a mechanical member. In this instance, the description that the fourth flange portion 161*a* of the suction muffler 161 can be interposed between the third flange portion 153 of the piston 150 and the first coupling portion 136*a* of the magnet frame 136, and they can be fixed together is the same as that described above.

The first resonant spring 118*a* may be disposed between a front surface of the back cover 123 and a rear surface of the spring supporter 119. The second resonant spring 118*b* may be disposed between a rear surface of the stator cover 137 and a front surface of the spring supporter 119.

A plurality of first and second resonant springs 118*a* and 118*b* may be disposed in the circumferential direction of the central axis. The first resonant springs 118*a* and the second resonant springs 118*b* may be disposed parallel to each other in the axial direction, or may be alternately disposed. The first and second resonant springs 118*a* and 118*b* may be disposed at regular intervals in the radial direction of the central axis. For example, three first resonant springs 118*a* and three second resonant springs 118*b* may be provided and may be disposed at intervals of 120 degrees in the radial direction of the central axis.

The compressor 100 may include a plurality of sealing members that can increase a coupling force between the frame 120 and the components around the frame 120.

For example, the plurality of sealing members may include a first sealing member that is interposed at a portion where the frame 120 and the discharge cover assembly 180 are coupled and is inserted into an installation groove provided at the front end of the frame 120, and a second sealing member that is provided at a portion at which the frame 120 and the cylinder 140 are coupled and is inserted into an installation groove provided at an outer surface of the cylinder 140. The second sealing member can prevent the refrigerant of the gas groove 125*c* between the inner circumferential surface of the frame 120 and the outer circumferential surface of the cylinder 140 from leaking to the outside, and can increase a coupling force between the frame 120 and the cylinder 140. The plurality of sealing members may further include a third sealing member that is provided at a portion at which the frame 120 and the inner stator 134 are coupled and is inserted into an installation groove provided at the outer surface of the frame 120. Here, the first to third sealing members may have a ring shape.

An operation of the linear compressor 100 described above is as follows.

First, when a current is applied to the drive unit 130, a magnetic flux may be formed in the outer stator 131 by the current flowing in the coil 132*b*. The magnetic flux formed in the outer stator 131 may generate an electromagnetic force, and the mover 135 including the permanent magnet may linearly reciprocate by the generated electromagnetic force. The electromagnetic force is generated in a direction (forward direction) in which the piston 150 is directed toward a top dead center (TDC) during a compression stroke, and is alternately generated in a direction (rearward direction) in which the piston 150 is directed toward a bottom dead center (BDC) during a suction stroke. That is, the drive unit 130 may generate a thrust which is a force for pushing the mover 135 and the piston 150 in a moving direction.

The piston 150 linearly reciprocating inside the cylinder 140 may repeatedly increase or reduce volume of the compression space 103.

When the piston 150 moves in a direction (rearward direction) of increasing the volume of the compression space 103, a pressure of the compression space 103 may decrease. Hence, the suction valve 155 mounted in front of the piston 150 is opened, and the refrigerant remaining in the suction space 102 may be suctioned into the compression space 103 along the suction port 154. The suction stroke may be performed until the piston 150 is positioned in the bottom dead center by maximally increasing the volume of the compression space 103.

The piston 150 reaching the bottom dead center may perform the compression stroke which switching its motion direction and moving in a direction (forward direction) of reducing the volume of the compression space 103. As the pressure of the compression space 103 increases during the compression stroke, the suctioned refrigerant may be compressed. When the pressure of the compression space 103 reaches a setting pressure, the discharge valve 171 is pushed out by the pressure of the compression space 103 and is opened from the cylinder 140, and the refrigerant can be discharged to the discharge space 104 through a separation space. The compression stroke can continue while the piston 150 moves to the top dead center at which the volume of the compression space 103 is minimized.

As the suction stroke and the compression stroke of the piston 150 are repeated, the refrigerant introduced into the accommodation space 101 inside the compressor 100 through the suction pipe 114 may be introduced into the suction space 102 inside the piston 150 by sequentially passing the suction guide 116*a*, the suction muffler 161, and the inner guide 162, and the refrigerant of the suction space 102 may be introduced into the compression space 103 inside the cylinder 140 during the suction stroke of the piston 150. After the refrigerant of the compression space 103 is compressed and discharged to the discharge space 104 during the compression stroke of the piston 150, the refrigerant may be discharged to the outside of the compressor 100 via the loop pipe 115*a* and the discharge pipe 115.

Figure 3:
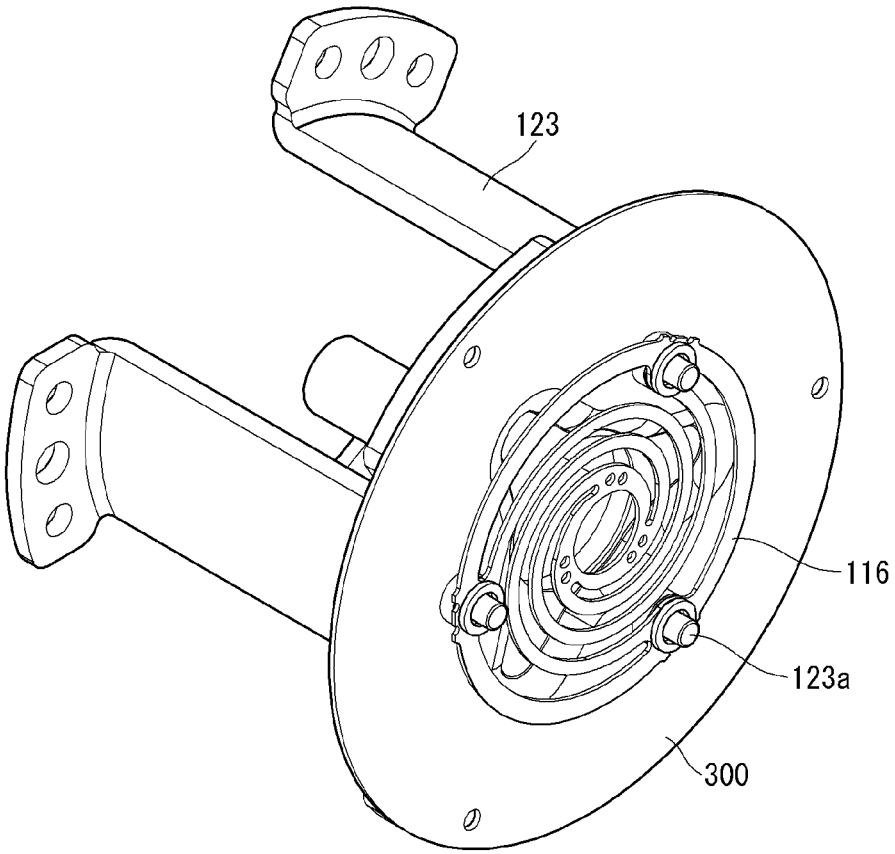
FIG. 3 is a perspective view of a partial configuration of a linear compressor according to an embodiment of the present disclosure.
Figure 4:
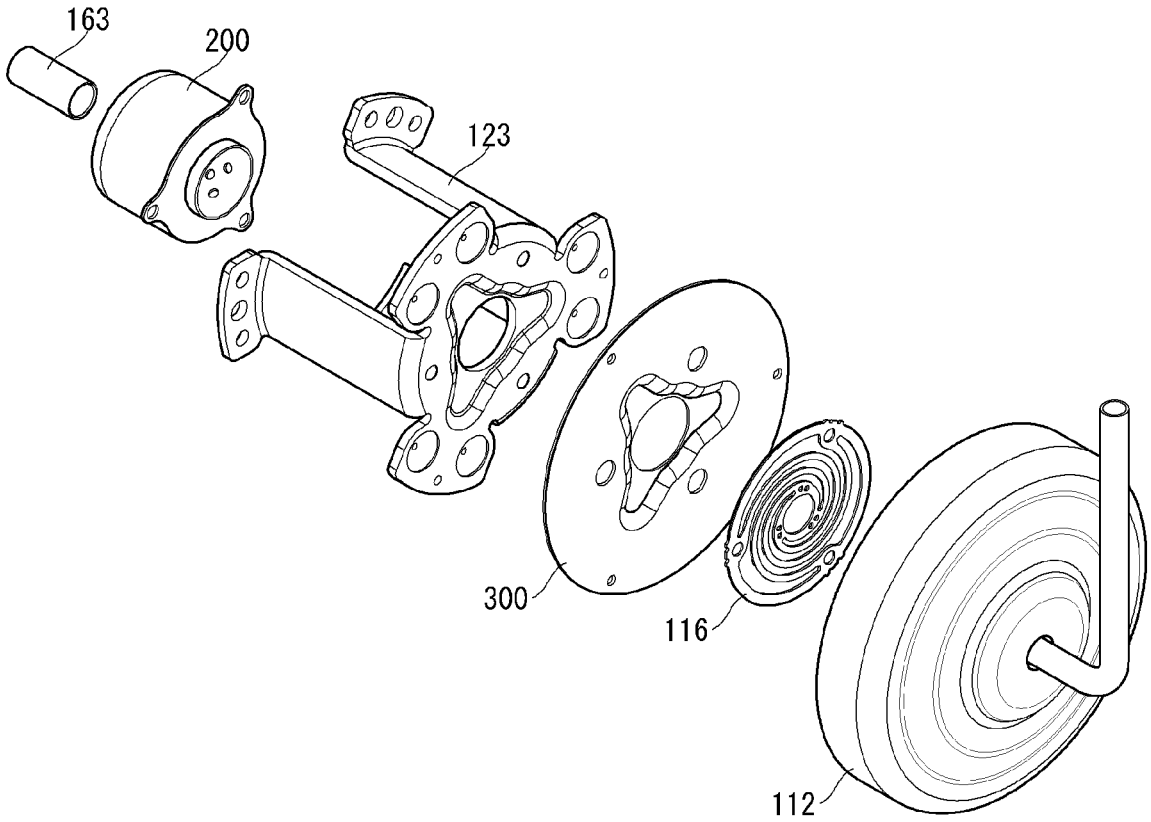
FIG. 4 is an exploded perspective view of a partial configuration of a linear compressor according to an embodiment of the present disclosure.
Figure 5:
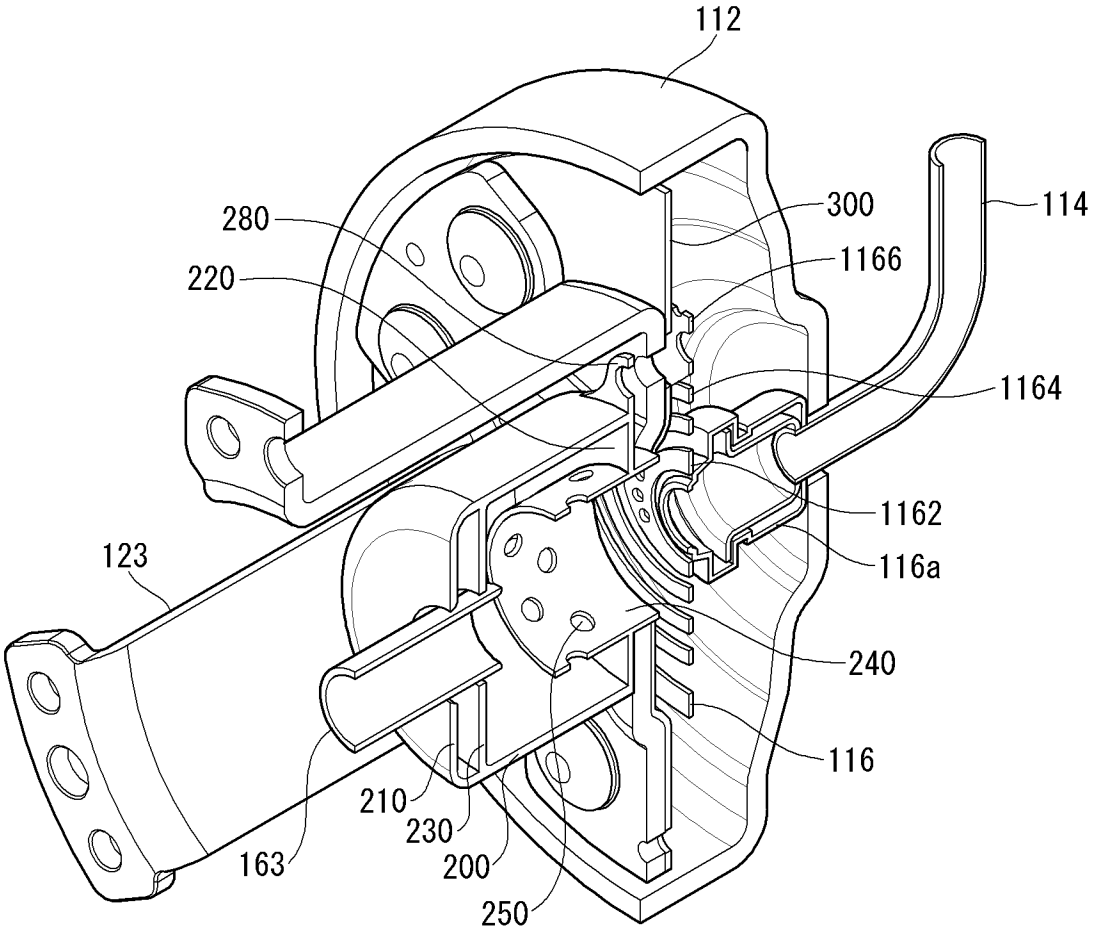
FIG. 5 is a cross-sectional perspective view of a partial configuration of a linear compressor according to an embodiment of the present disclosure.
Figure 6:
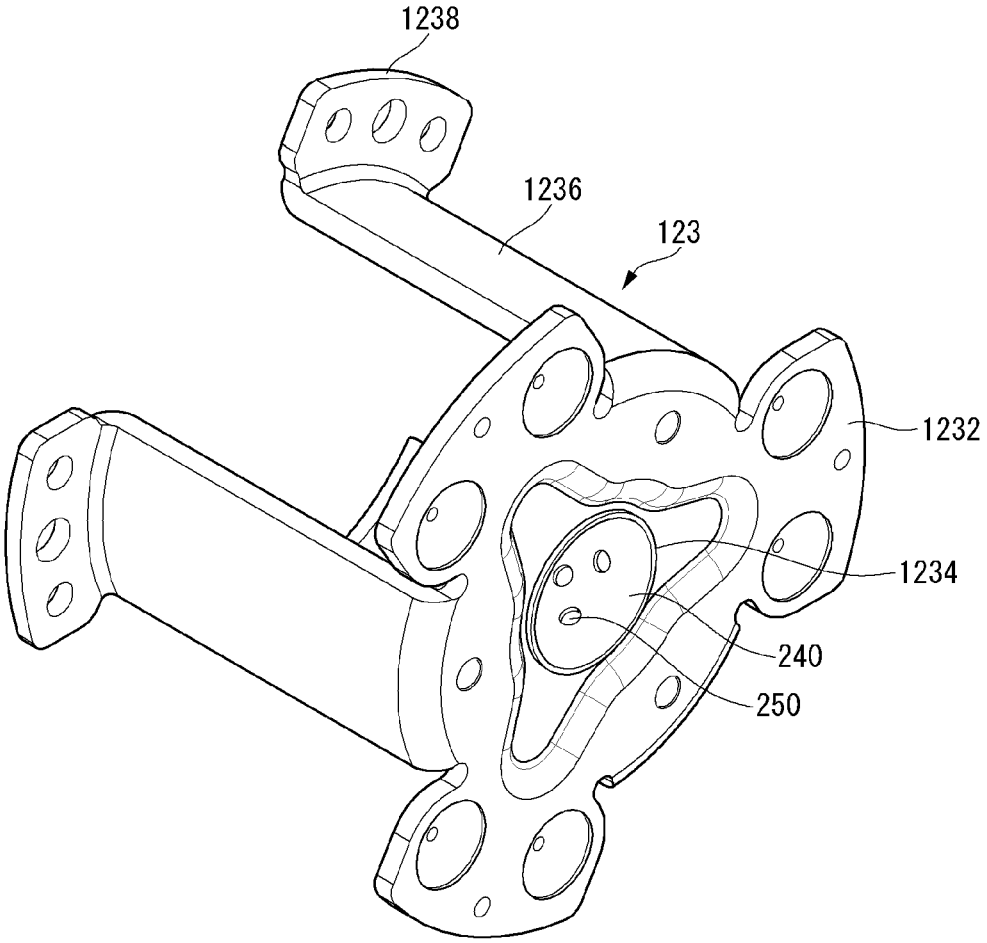
FIG. 6 is a perspective view of a back cover and an intake flow path member of a linear compressor according to an embodiment of the present disclosure.
Figure 7:
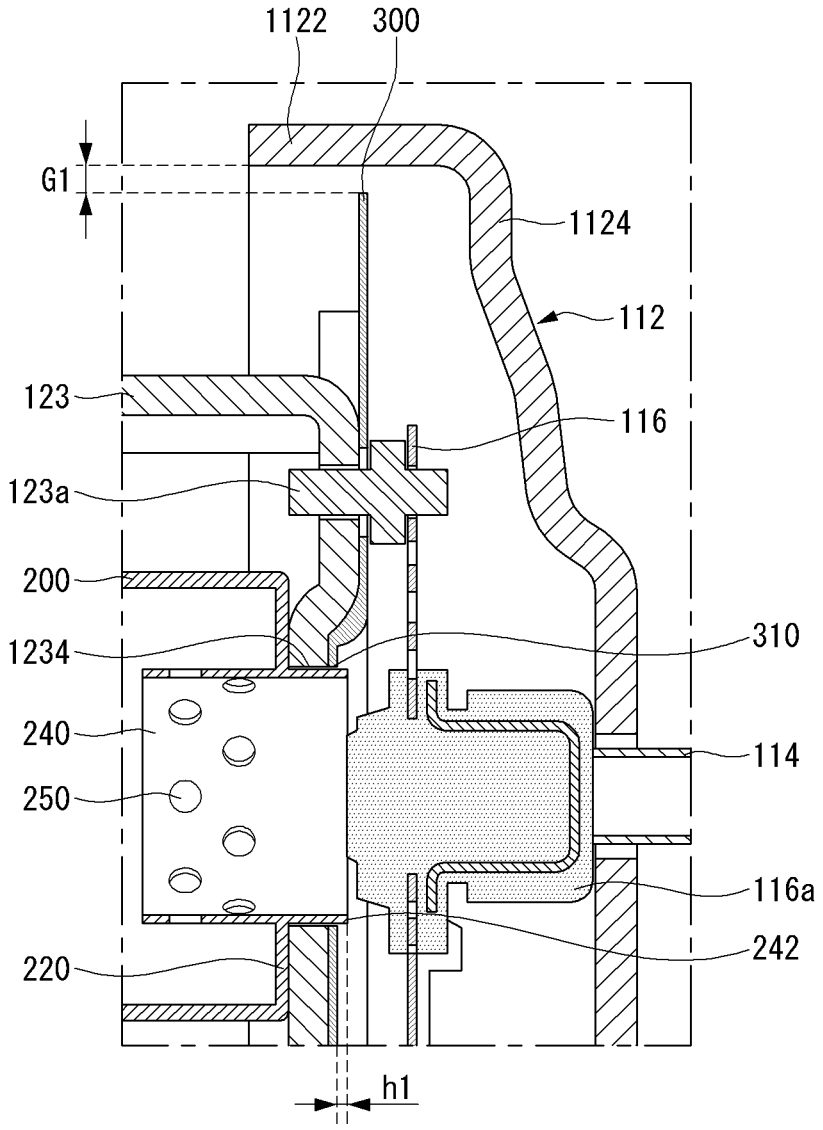
FIG. 7 is a cross-sectional view of a partial configuration of a linear compressor according to an embodiment of the present disclosure.
Figure 8:
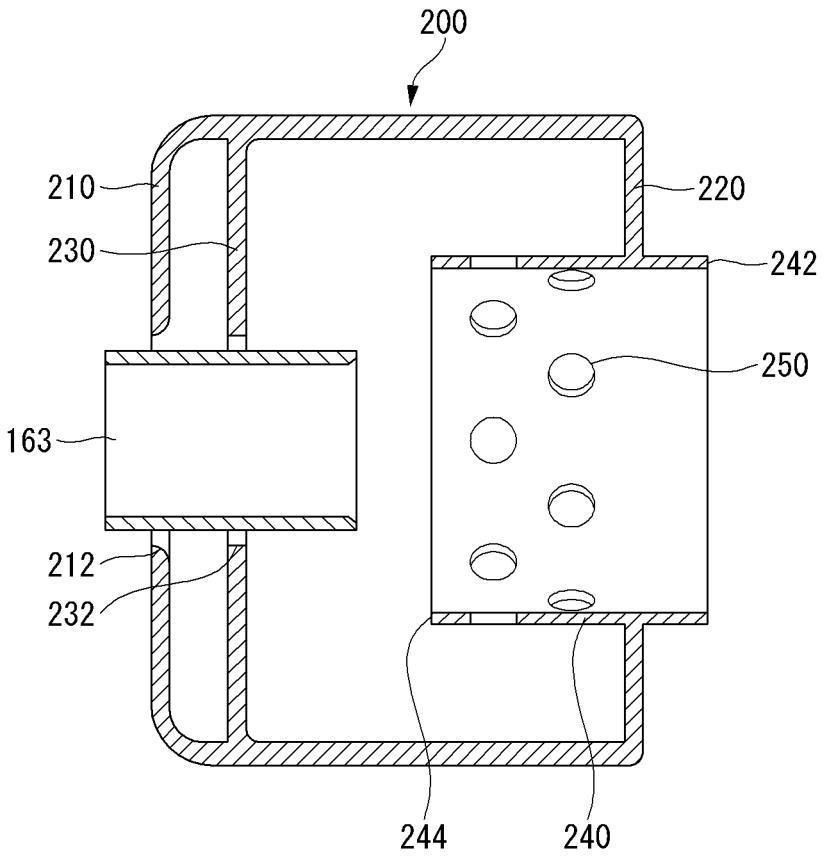
FIG. 8 is a cross-sectional view of an intake flow path member of a linear compressor according to an embodiment of the present disclosure.

FIG. 3 is a perspective view of a partial configuration of a linear compressor according to an embodiment of the present disclosure. FIG. 4 is an exploded perspective view of a partial configuration of a linear compressor according to an embodiment of the present disclosure. FIG. 5 is a cross-sectional perspective view of a partial configuration of a linear compressor according to an embodiment of the present disclosure. FIG. 6 is a perspective view of a back cover and an intake flow path member of a linear compressor according to an embodiment of the present disclosure. FIG. 7 is a cross-sectional view of a partial configuration of a linear compressor according to an embodiment of the present disclosure. FIG. 8 is a cross-sectional view of an intake flow path member of a linear compressor according to an embodiment of the present disclosure.

Referring to FIGS. 3 to 8, a linear compressor 100 according to an embodiment of the present disclosure may include a casing 110, an intake pipe 114, an intake guide 116*a*, a back cover 123, an intake flow path member 200, an intake muffler 161, a heat blocking member 300, a fastening member 123*a*, and a first support spring 116. However, the linear compressor 100 may be implemented including more or less components according to an embodiment.

In an embodiment of the present disclosure, it can be understood that an axial direction means a vertical direction in FIG. 2 and a horizontal direction in FIG. 7, an axially front means a downward direction in FIG. 2 and a left direction in FIG. 7, and an axially rear means an upward direction in FIG. 2 and a right direction in FIG. 7.

The casing 110 may include a shell 111 formed in a cylindrical shape that is open at both ends and is extended in the axial direction, a first shell cover 112 coupled to an axially rear side of the shell 111, and a second shell cover 113 coupled to an axially front side of the shell 111.

The intake pipe 114 may be coupled to the casing 110. The intake pipe 114 may pass through the second shell cover 113. The intake pipe 114 may communicate with the intake guide 116*a*. The intake pipe 114 may guide a suction refrigerant introduced from the outside to the intake guide 116*a*.

The intake guide 116*a* may have a through passage formed therein. The through passage of the intake guide 116*a* may communicate with the intake pipe 114 and the intake flow path member 200. The through passage of the intake guide 116*a* may communicate with a flow path guide 240 of the intake flow path member 200. The intake guide 116*a* may be entirely formed in a cylindrical shape. An axially rear end of the intake guide 116*a* may be supported by the casing 110. The axially rear end of the intake guide 116*a* may be supported by a front surface of the first shell cover 112. A front area of the intake guide 116*a* may be coupled to an inside portion of the first support spring 116.

The back cover 123 may be disposed in the casing 110. The back cover 123 may be supported in the casing 110. The intake flow path member 200 may be coupled to the back cover 123. The back cover 123 may be coupled to the first support spring 116. The back cover 123 may support a rear end of a first resonance spring 118*a*. The back cover 123 may be coupled to a stator cover 137.

The back cover 123 may include a rear surface 1232, at least one first area 1236 extending axially forward from a radially outer area of the rear surface 1232, and a second area 1238 bending radially outward from each of the at least one first area 1236.

The heat blocking member 300 may be coupled to the rear surface 1232 of the back cover 123. The intake flow path member 200 may be disposed on a front surface positioned opposite the rear surface 1232 of the back cover 123. The rear surface of the back cover 123 may include a third hole 1234 formed in the central area. The third hole 1234 may be penetrated by the flow path guide 240.

The intake flow path member 200 may be disposed at a radially inside of at least one first area 1236 of the back cover 123. A radially inner surface of at least one first area 1236 of the back cover 123 may be radially spaced apart from an outer surface of the intake flow path member 200.

The second area 1238 of the back cover 123 may be coupled to the stator cover 137. In an embodiment of the present disclosure, the second area 1238 of the back cover 123 and the stator cover 137 are bolted to each other as an example, but the present disclosure is not limited thereto and may be variously changed.

The intake flow path member 200 may be coupled to the back cover 123. At least a portion of the intake muffler 161 may linearly reciprocate inside the intake flow path member 200. Specifically, a rear area 163 of the intake muffler 161 may linearly reciprocate axially inside the intake flow path member 200. The intake flow path member 200 may be formed in a cylindrical shape in which a central portion of a front surface 210 and a center portion of a rear surface 220 are opened.

The intake flow path member 200 may include a first hole 212 formed in the front surface 210. The first hole 212 may be penetrated by a rear area 163 of the intake muffler 161. A diameter of the first hole 212 may be greater than an outer diameter of the rear area 163 of the intake muffler 161.

The intake flow path member 200 may include the flow path guide 240 extending axially forward from the central portion of the rear surface 220. The flow path guide 240 may be formed in a cylindrical shape in which a front and a rear are opened. A suction refrigerant passing through the intake guide 116*a* may be introduced into the flow path guide 240. A noise of the refrigerant passing through the intake flow path member 200 can be reduced through an expansion space formed between the flow path guide 240 and the inner surface of the intake flow path member 200. In this case, the flow path guide 240 can minimize a pressure loss due to the expansion of the suction refrigerant to prevent a compression loss of the linear compressor 100.

The flow path guide 240 may include a plurality of holes 250 that is spaced apart from each other and communicates the inside of the flow path guide 240 with a space between the flow path guide 240 and the inner surface of the intake flow path member 200. A cross-section of the plurality of holes 250 is described to be formed in a circular shape as an example, but the present disclosure is not limited thereto and may be formed in an oval shape. Hence, the present disclosure can reduce an amount of refrigerant flowing back from the rear area 163 of the intake muffler 161 and reduce interference with the suction refrigerant to prevent a loss of the suction refrigerant.

The flow path guide 240 may be disposed in the intake flow path member 200. A diameter of the flow path guide 240 may be greater than a diameter of the first hole 212. The diameter of the flow path guide 240 may be greater than a diameter of the intake guide 116*a*. Hence, the present disclosure can prevent the suction refrigerant introduced through the intake guide 116*a* from being dissipated to the outside of the intake flow path member 200.

The intake flow path member 200 may include a partition wall 230 disposed at the axially rear of the front surface 210. The partition wall 230 may include a second hole 232 penetrated by the rear area 163 of the intake muffler 161. A diameter of the second hole 232 may be greater than a diameter of the rear area 163 of the intake muffler 161.

A rear end of the flow path guide 240 may extend rearward from the rear surface 220 of the intake flow path member 200. An axially rear end 242 of the flow path guide 240 may pass through the third hole 1234 formed in the central area of the back cover 123 and protrude rearward.

Hence, the present disclosure can prevent the refrigerant between the rear surface 1232 of the back cover 123 and the casing 110 from being introduced into a space between the intake flow path member 200 and the intake guide 116*a*. Specifically, the present disclosure can prevent the refrigerant between the rear surface 1232 of the back cover 123 and an inner surface of the first shell cover 112 from being introduced into the space between the intake flow path member 200 and the intake guide 116*a* and from causing interference with the suction refrigerant, and can prevent the suction refrigerant introduced into the flow path guide 240 via the intake guide 116*a* from being dissipated.

The intake flow path member 200 may include an extension 280 extending radially outward from the rear surface 220. A fastening hole formed in the extension 280 may be penetrated by the fastening member 123*a*. FIG. 5 describes and illustrates that the extension 280 extends radially outward from the rear surface 220 of the intake flow path member 200 by way of example, but the present disclosure is not limited thereto. For example, the extension 280 may extend radially outward and axially rearward from the rear surface 220 of the intake flow path member 200, thereby improving space efficiency.

The intake muffler 161 may be coupled to a piston 150. The intake muffler 161 may axially reciprocate together with the piston 150. At least a portion of the intake muffler 161 may linearly reciprocate inside the intake flow path member 200. Specifically, the rear area 163 of the intake muffler 161 may linearly reciprocate inside the intake flow path member 200.

The heat blocking member 300 may be coupled to the rear surface 1232 of the back cover 123. The heat blocking member 300 may protrude radially outward further than the back cover 123. The heat blocking member 300 may be disposed closer to a side surface 1122 of the first shell cover 112 than the back cover 123. Hence, a refrigerant in the front of the back cover 123 can be prevented from moving to the rear area of the back cover 123 through the space between the radially outer surface of the back cover 123 and the inner surface of the casing 110. Specifically, a refrigerant that is positioned in front of the back cover 123 and has a higher temperature than a temperature of the suction refrigerant can be prevented from being introduced into the rear area of the back cover 123 through a space between the radially outer surface of the back cover 123 and the side surface 1122 of the first shell cover 112, thereby preventing an increase in the temperature of the suction refrigerant.

The heat blocking member 300 may be spaced apart from the inner surface of the casing 110. The heat blocking member 300 may be spaced apart from the inside of the side surface 1122 of the first shell cover 112. Hence, the present disclosure can prevent a collision of the components due to vibration generated during the operation of the linear compressor 100.

The heat blocking member 300 may include a fourth hole 310 formed in the central area. The fourth hole 310 may be penetrated by the axially rear end 242 of the flow path guide 240. Specifically, the axially rear end 242 of the flow path guide 240 may pass through the fourth hole 310 and protrude rearward further than the heat blocking member 300. Hence, the present disclosure can prevent the refrigerant between the heat blocking member 300 and the casing 110 from being introduced into the space between the intake flow path member 200 and the intake guide 116*a*. Specifically, the present disclosure can prevent the refrigerant positioned between the heat blocking member 300 and the inner surface of the first shell cover 112 from being introduced into the space between the intake flow path member 200 and the intake guide 116*a* and from causing interference with the suction refrigerant, and can prevent the suction refrigerant introduced into the flow path guide 240 via the intake guide 116*a* from being dissipated.

An area adjacent to the fourth hole 310 of the heat blocking member 300 may protrude axially forward. At the same time, an area adjacent to the third hole 1234 in the rear surface 1232 of the back cover 123 may protrude axially forward. Hence, space efficiency can be improved.

The first support spring 116 may be a 'plate spring'. The first support spring 116 may be coupled to the intake guide 116*a*, the back cover 123, the heat blocking member 300, and the intake flow path member 200.

The first support spring 116 may include an inner portion 1162 connected to the intake guide 116*a*, an outer portion 1166 connected to the back cover 123, and a connection portion 1164 connecting the inner portion 1162 and the outer portion 1166. The outer portion 1166 may be coupled to the back cover 123, the intake flow path member 200, and the heat blocking member 300.

The fastening member 123*a* may couple the back cover 123, the first support spring 116, the intake flow path member 200, and the heat blocking member 300. Specifically, the fastening member 123*a* may sequentially pass through a fastening hole formed in the outer portion 1166 of the first support spring 116, a fastening hole formed in the heat blocking member 300, a fastening hole formed in the rear surface 1232 of the back cover 123, and a fastening hole formed in the extension 280 extending radially outward from the rear surface 220 of the intake flow path member 200 to simultaneously couple the back cover 123, the first support spring 116, the intake flow path member 200, and the heat blocking member 300. Hence, the present disclosure can improve the space efficiency and can couple the back cover 123, the first support spring 116, the intake flow path member 200, and the heat blocking member 300 without a separate process such as adhesion.

Figure 9:
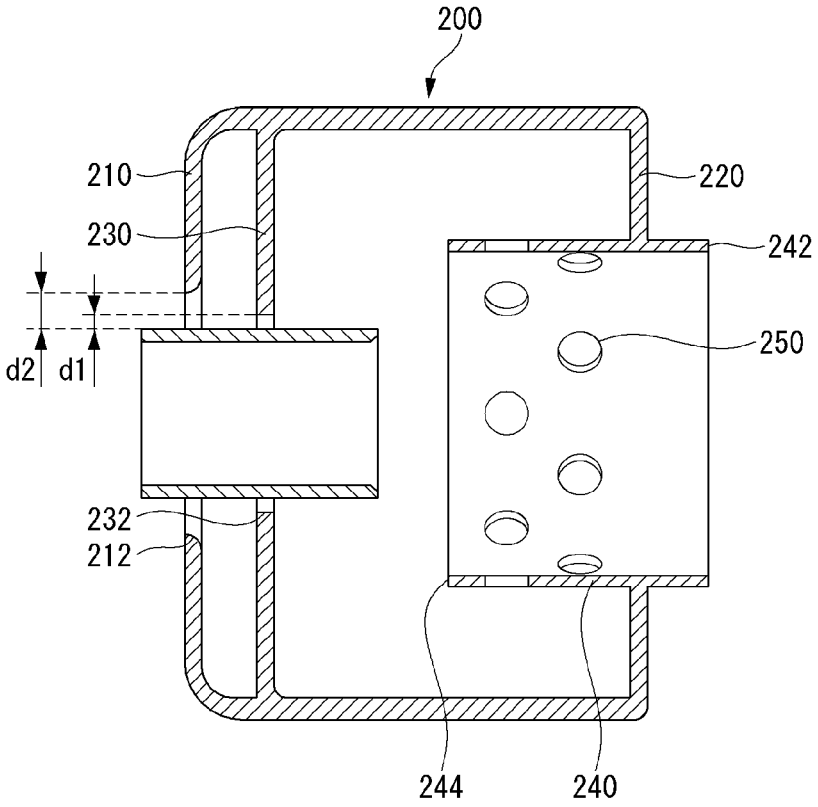
FIGS. 9 to 11 illustrate modified examples of an intake flow path member of a linear compressor according to an embodiment of the present disclosure.
Figure 10:
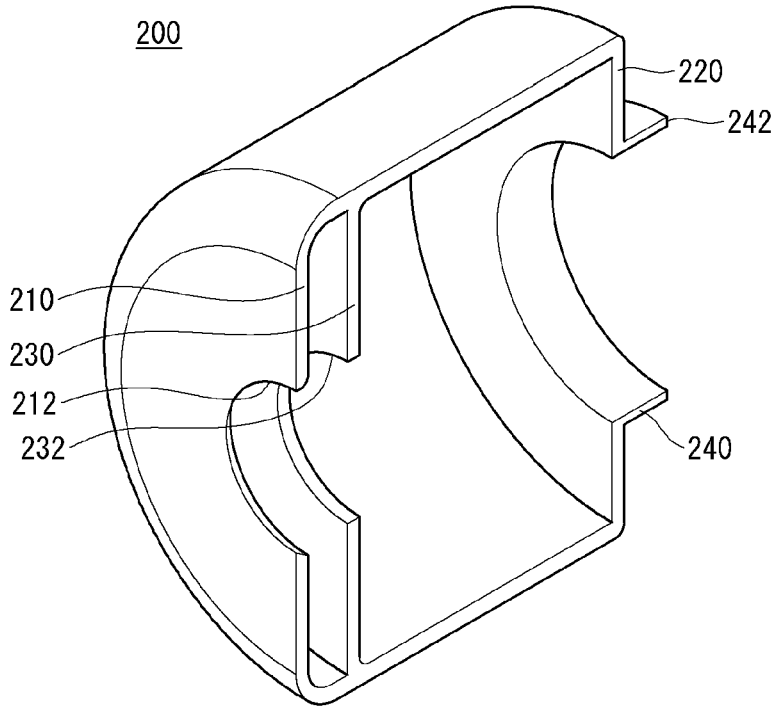
Figure 11:
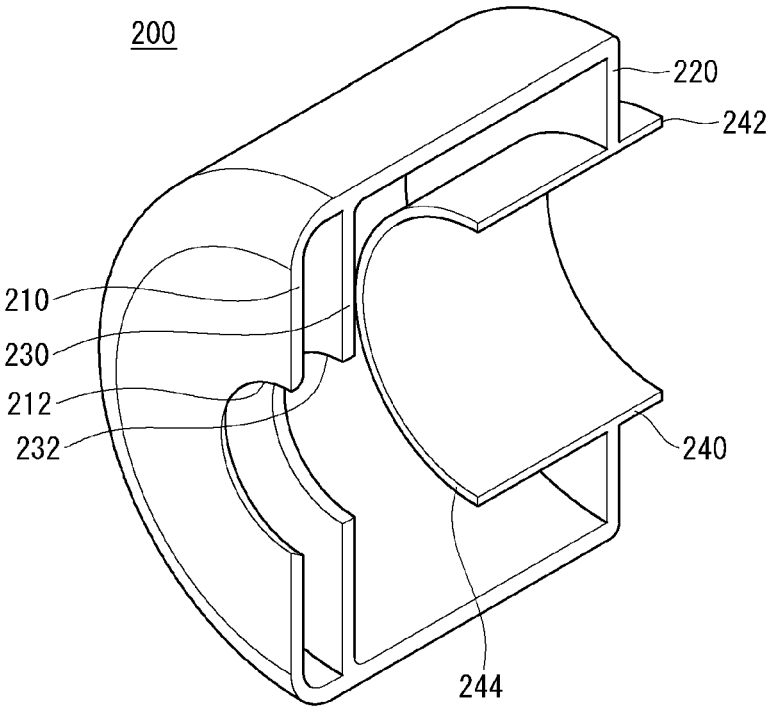

FIGS. 9 to 11 illustrate modified examples of an intake flow path member of a linear compressor according to an embodiment of the present disclosure.

Referring to FIG. 9, a diameter of the second hole 232 may be less than a diameter of the first hole 212. The second hole 232 may be disposed radially closer to the outer surface of the rear area 163 of the intake muffler 161 than the first hole 212. Specifically, a distance d1 between the second hole 232 and the rear area 163 of the intake muffler 161 may be less than a distance d2 between the first hole 212 and the rear area 163 of the intake muffler 161. Hence, the present disclosure can prevent the refrigerant outside the intake muffler 161 from flowing back through the space between the rear area 163 of the intake muffler 161 and the intake flow path member 200.

Referring to FIG. 10, the flow path guide 240 may protrude only rearward from the rear surface 220 of the intake flow path member 200. The flow path guide 240 may be formed in a cylindrical shape in which a front and a rear are opened.

Referring to FIG. 11, the flow path guide 240 may protrude axially forward and rearward from the rear surface 220 of the intake flow path member 200. The flow path guide 240 may be formed in a cylindrical shape in which a front and a rear are opened. In this case, the plurality of holes 250 may not be formed in the flow guide 240.

Figure 12:
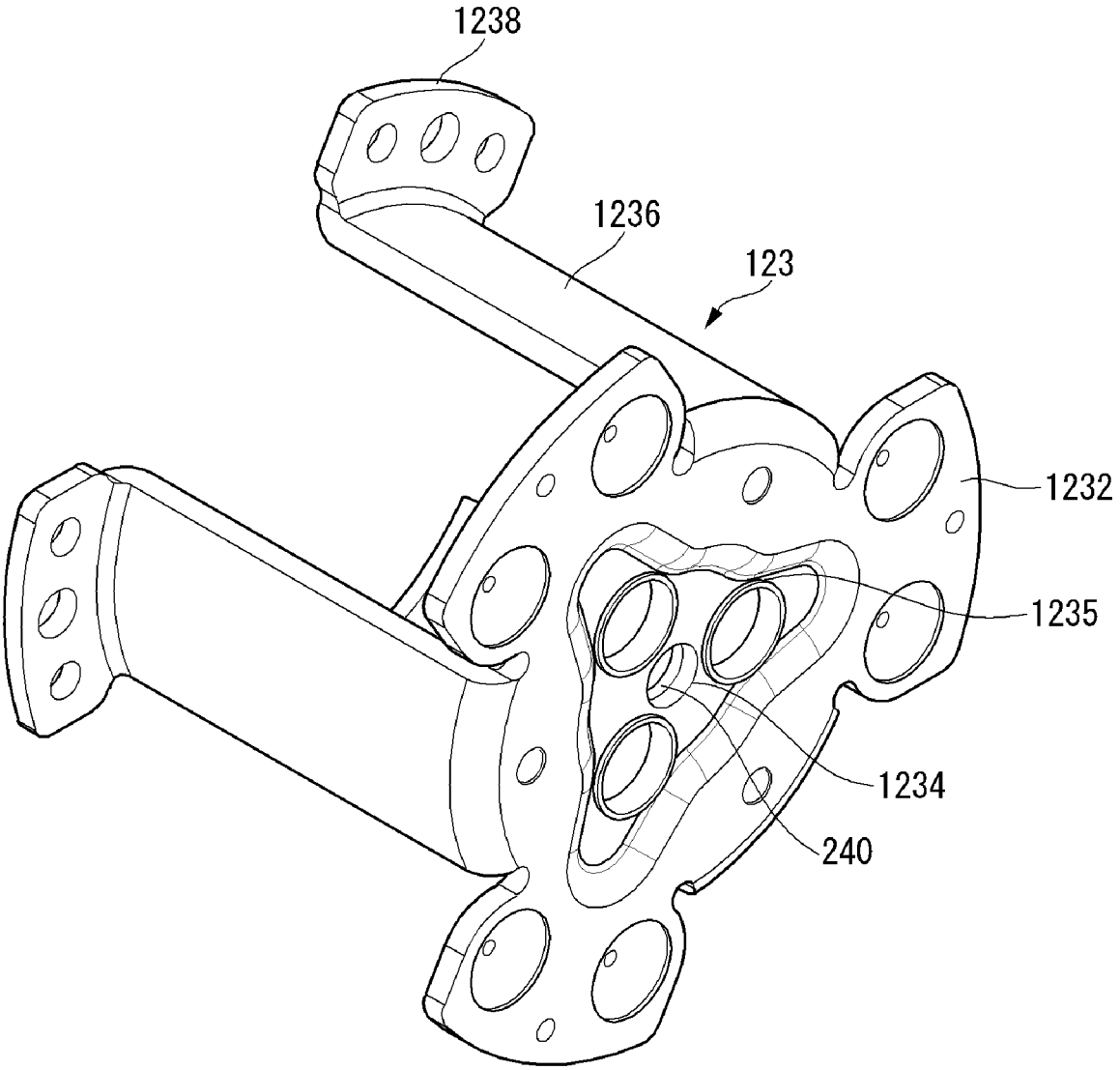
FIG. 12 is a perspective view illustrating a modified example of a back cover and an intake flow path member of a linear compressor according to an embodiment of the present disclosure.
Figure 13:
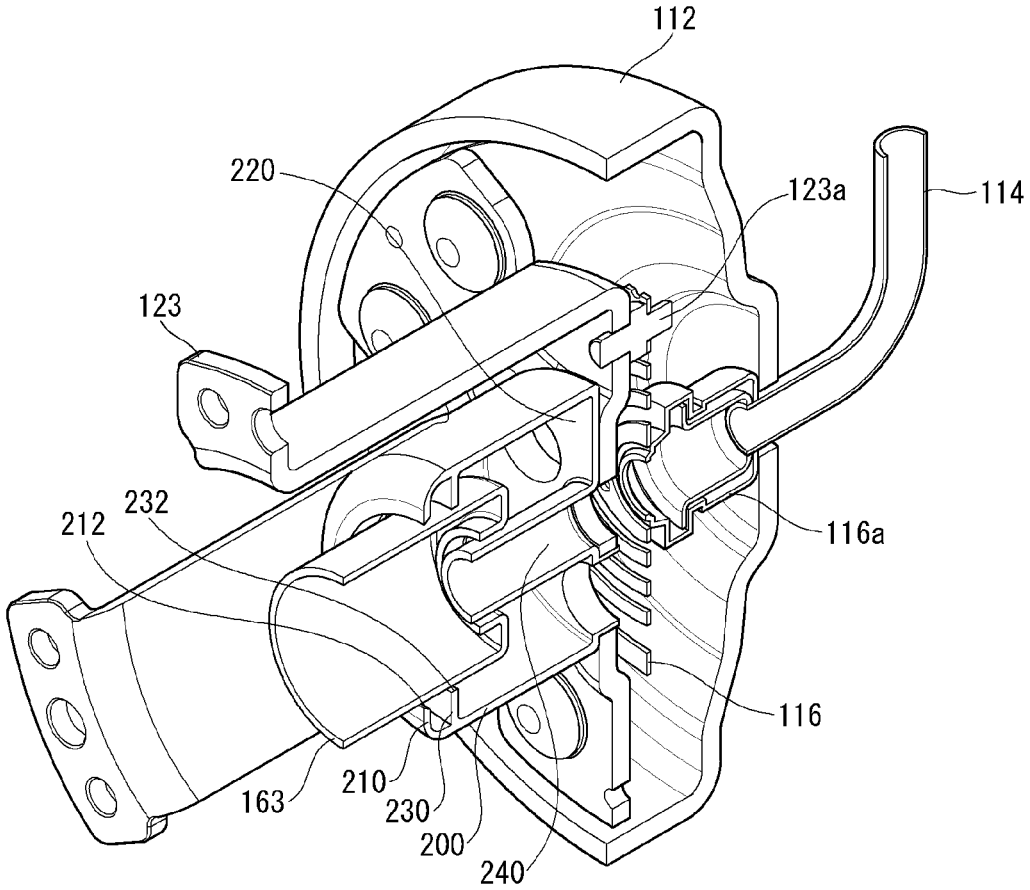
FIG. 13 is a cross-sectional perspective view illustrating a modified example of a partial configuration of a linear compressor according to an embodiment of the present disclosure.

FIG. 12 is a perspective view illustrating a modified example of a back cover and an intake flow path member of a linear compressor according to an embodiment of the present disclosure. FIG. 13 is a cross-sectional perspective view illustrating a modified example of a partial configuration of a linear compressor according to an embodiment of the present disclosure.

Referring to FIGS. 12 and 13, the flow path guide 240 may protrude axially forward. The flow path guide 240 may be formed in a cylindrical shape in which a front and a rear are opened. An outer diameter of the flow path guide 240 may be less than a diameter of the first hole 212 formed in the front surface 210 of the intake flow path member 200 and a diameter of the second hole 232 formed in the partition wall 230. In this case, when the rear area 163 of the intake muffler 161 moves rearward, the front area of the flow path guide 240 may be disposed in the rear area 163 of the intake muffler 161. Hence, the present disclosure can prevent the refrigerant outside the intake muffler 161 from flowing backward through the space between the intake flow path member 200 and the rear area 163 of the intake muffler 161.

The back cover 123 may include a plurality of fifth holes 1235 disposed radially outward further than the third hole 1234. The plurality of fifth holes 1235 may be spaced apart from each other in a circumferential direction. The plurality of fifth holes 1235 may communicate with a space between the inner surface of the intake flow path member 200 and the flow path guide 240. Hence, the present disclosure can prevent a reduction in an amount of suction refrigerant by guiding the suction refrigerant, that is dissipated to the outside of the intake flow path member 200 among the suction refrigerant introduced through the intake guide 116*a*, to the inside of the intake flow path member 200.

FIGS. 12 and 13 describe and illustrate that the flow path guide 240 protrudes axially forward, by way of example. However, it is obvious that the flow path guide 240 can protrude rearward from the rear surface 220. FIGS. 12 and 13 illustrate that the heat blocking member 300 is omitted, but the heat blocking member 300 can be disposed. In this case, the heat blocking member 300 may include a plurality of sixth holes (not shown) formed at a position opposite the fifth holes 1235.

Figure 14:
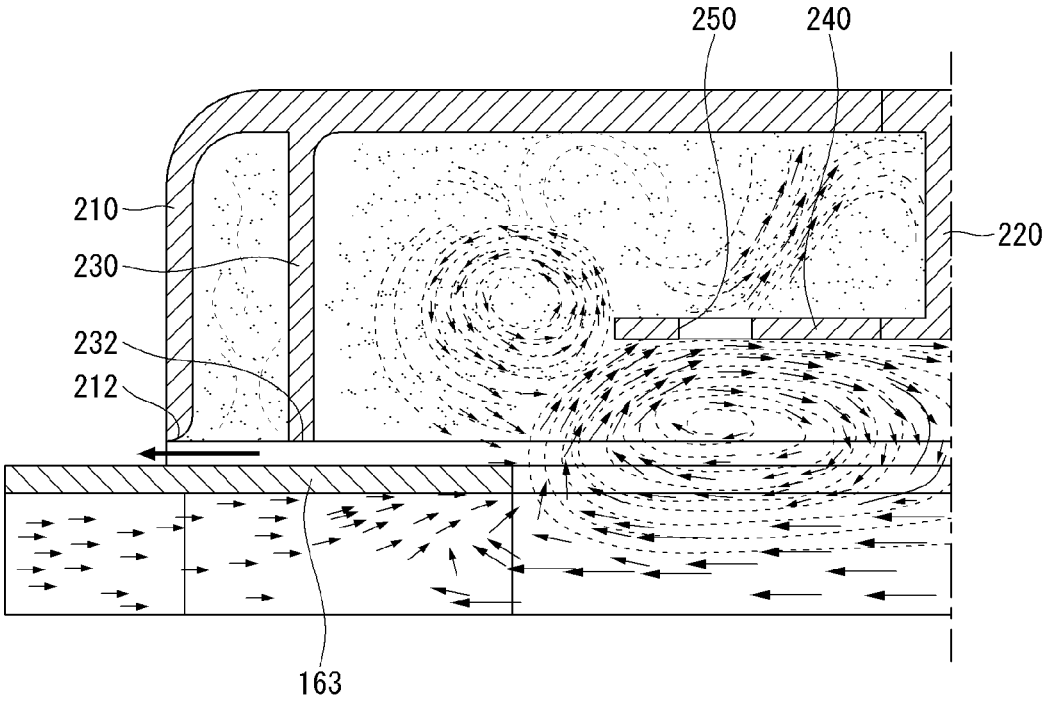
FIGS. 14 and 15 illustrate a fluid flow in an intake flow path member and an intake muffler during an operation of a linear compressor according to an embodiment of the present disclosure.
Figure 15:
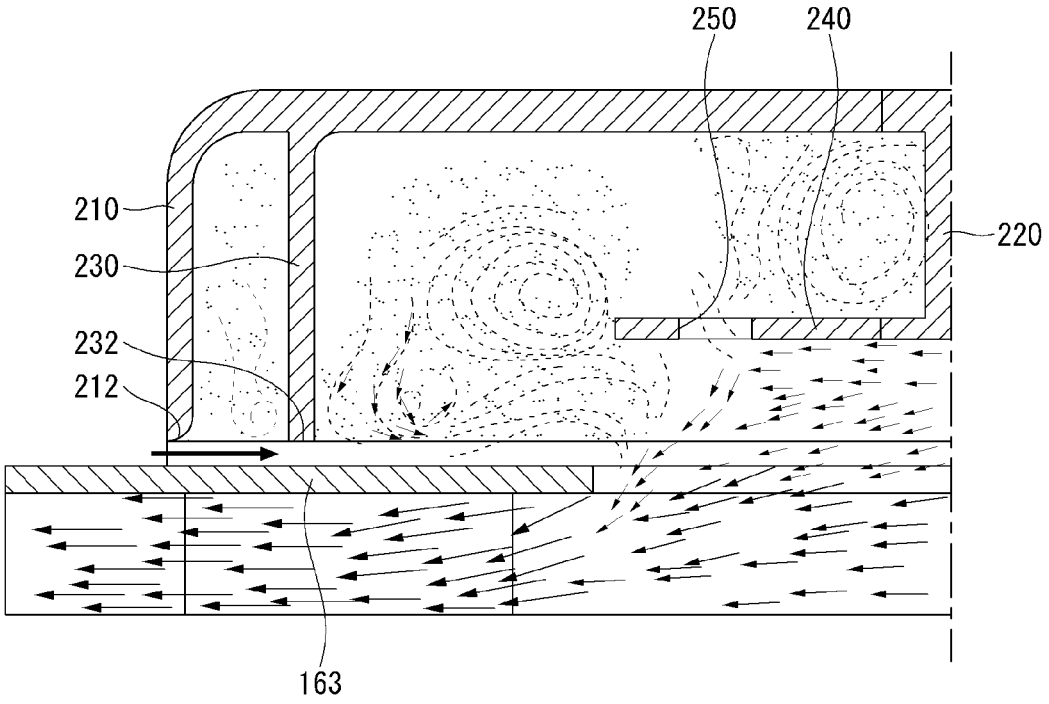
Figure 16:
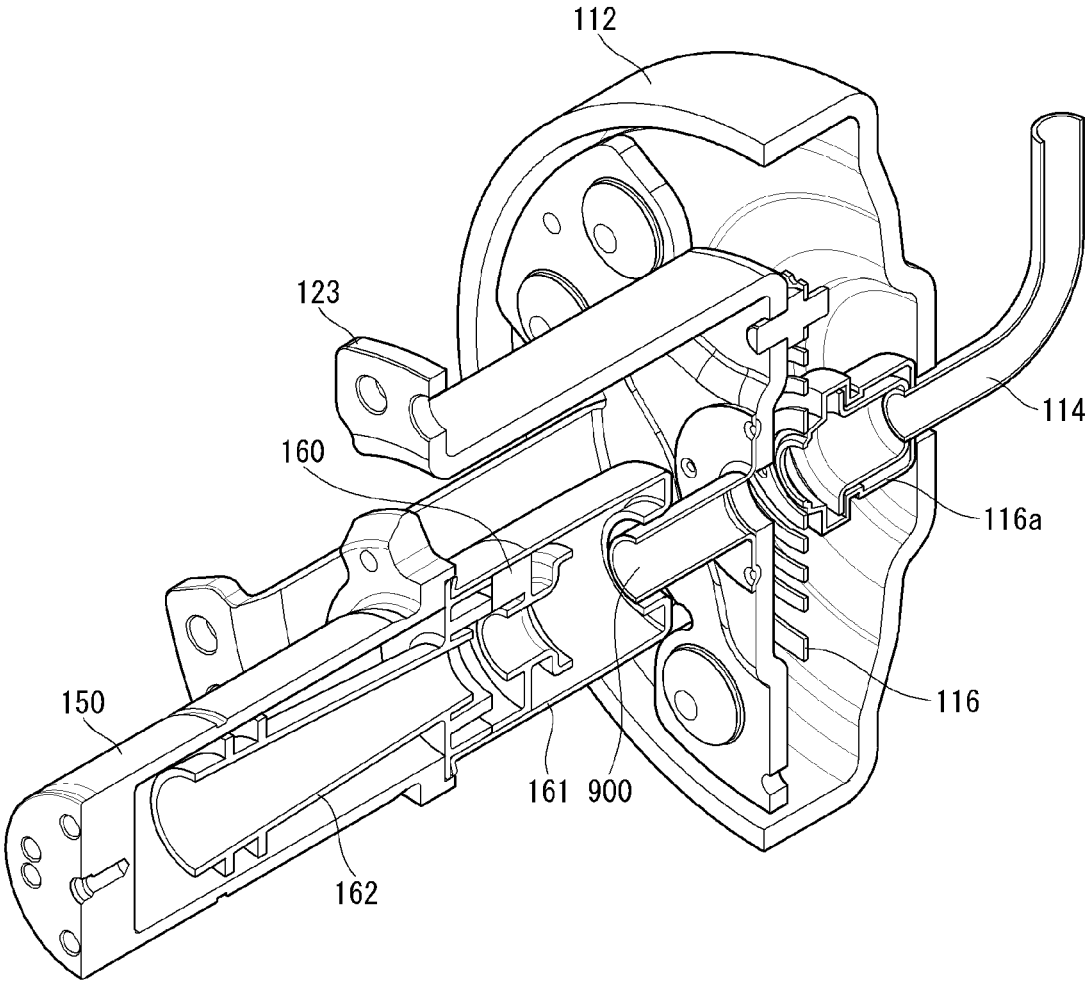
FIG. 16 is a cross-sectional perspective view of a partial configuration of a linear compressor according to a related art.
Figure 17:
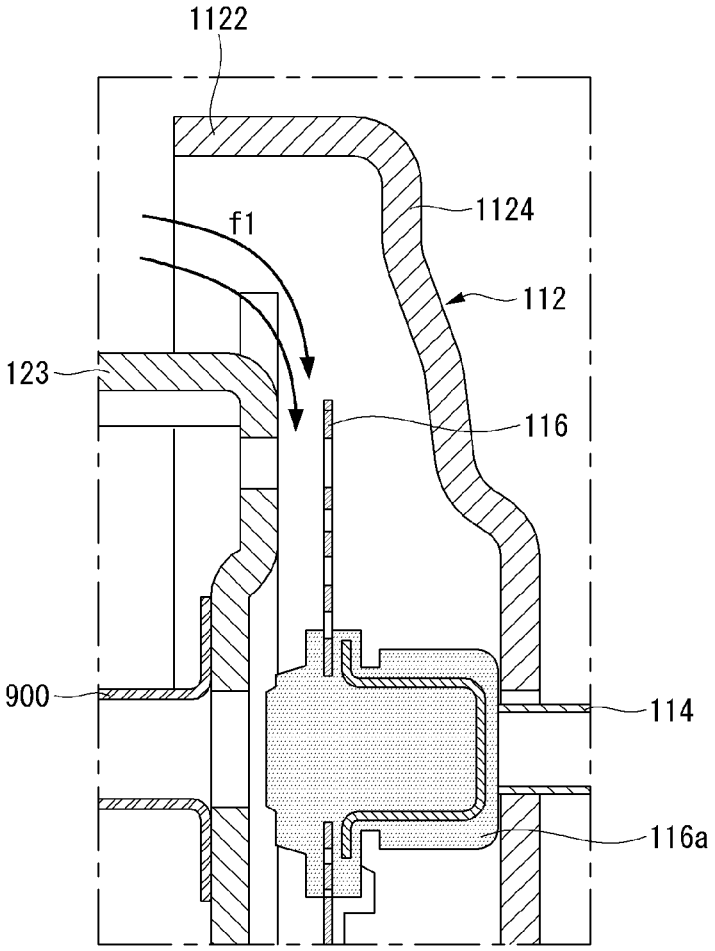
FIG. 17 is a cross-sectional view of a partial configuration of a linear compressor according to a related art.
Figure 18:
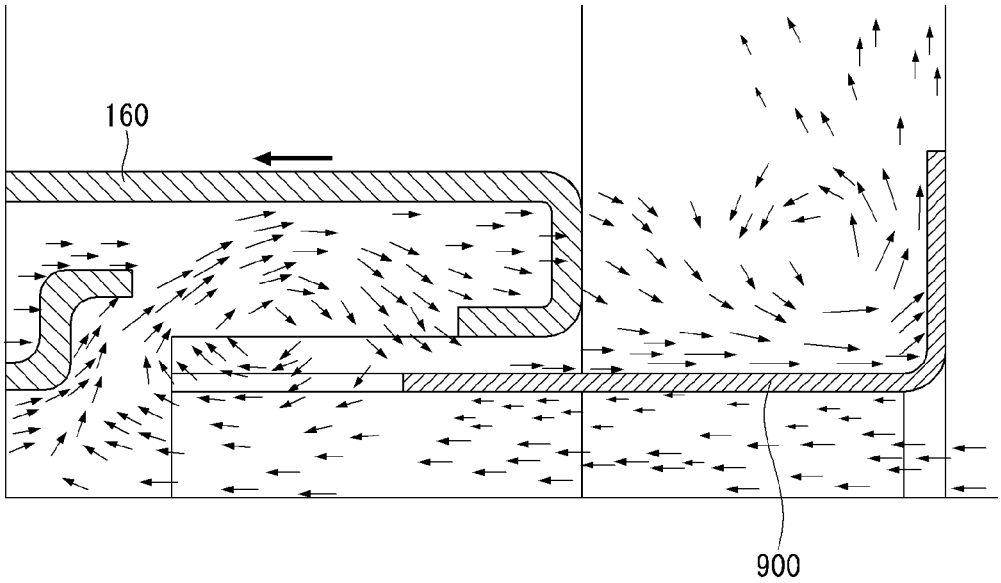
FIGS. 18 and 19 illustrate a fluid flow during an operation of a linear compressor according to a related art.
Figure 19:
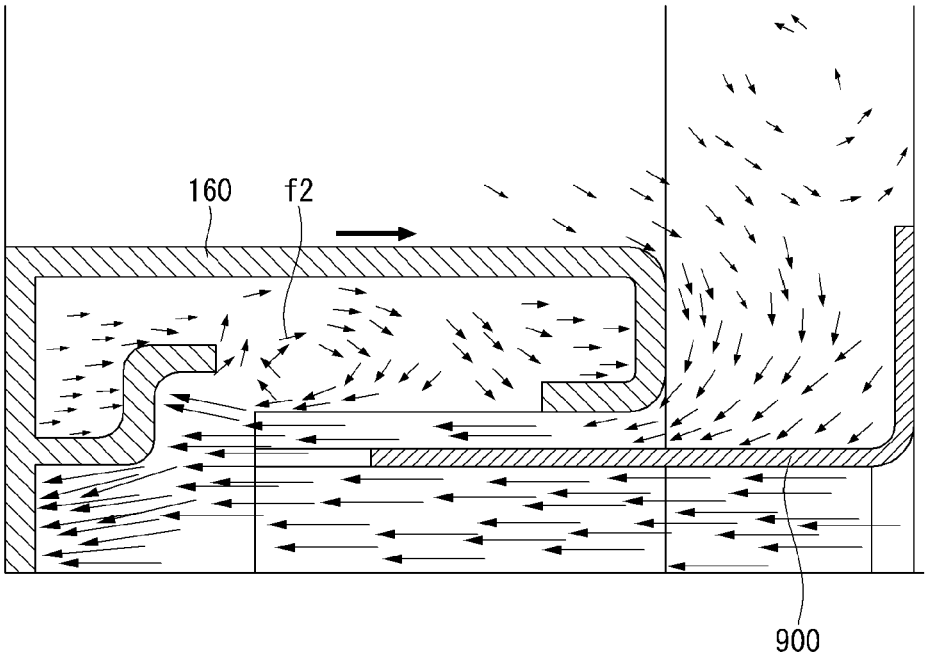

FIGS. 14 and 15 illustrate a fluid flow in an intake flow path member and an intake muffler during an operation of a linear compressor according to an embodiment of the present disclosure.

Referring to FIGS. 14 and 15, when the piston 150 moves axially forward, the rear area 163 of the intake muffler 161 coupled to the piston 150 moves forward. In this case, the refrigerant in the space between the flow path guide 240 and the inner surface of the intake flow path member 200 through the plurality of holes 250 can be prevented from flowing back into the flow path guide 240. Hence, the present disclosure enables a smooth flow of the suction refrigerant passing through the intake flow path member 200 and thus can improve the compression efficiency of the linear compressor 100.

Some embodiments or other embodiments of the present disclosure described above are not exclusive or distinct from each other. Some embodiments or other embodiments of the present disclosure described above can be used together or combined in configuration or function.

For example, configuration "A" described in an embodiment and/or the drawings and configuration "B" described in another embodiment and/or the drawings can be combined with each other. That is, even if the combination between the configurations is not directly described, the combination is possible except in cases where it is described that it is impossible to combine.

The above detailed description is merely an example and is not to be considered as limiting the present disclosure. The scope of the present disclosure should be determined by rational interpretation of the appended claims, and all variations within the equivalent scope of the present disclosure are included in the scope of the present disclosure.

What is claimed is:

1. A linear compressor comprising:

a casing;

a back cover disposed in the casing;

an intake flow path member that is coupled to the back cover and has a front surface and a rear surface that are spaced apart from each other in an axial direction of the casing, the intake flow path member comprising a flow path guide that extends axially forward from the rear surface of the intake flow path member and has open ends; and an intake muffler configured to linearly reciprocate relative to the intake flow path member, at least a portion of the intake muffler being disposed inside the intake flow path member, wherein the intake flow path member defines a first hole at the front surface thereof, the first hole being configured to receive the intake muffler, and wherein the flow path guide defines a plurality of holes that are spaced apart from one another and fluidly communicate an inside of the flow path guide with a space defined between an outer surface of the flow path guide and an inner surface of the intake flow path member.

2. The linear compressor of claim 1, wherein the flow path guide is disposed inside the intake flow path member, and wherein a diameter of the flow path guide is greater than a diameter of the first hole.

3. The linear compressor of claim 1, further comprising:

a heat blocking member that is coupled to a rear surface of the back cover and protrudes radially outward relative to the back cover.

4. The linear compressor of claim 3, wherein an outer surface of the heat blocking member is disposed adjacent to an inner surface of the casing.

5. The linear compressor of claim 3, wherein the flow path guide has a rear end that is disposed axially rearward relative to the rear surface of the intake flow path member, the rear end of the flow path guide protruding to the heat blocking member and passing through a central area of the heat blocking member.

6. The linear compressor of claim 1, further comprising:

an intake pipe coupled to the casing and configured to suction a refrigerant from an outside of the casing;

an intake guide that is disposed between the intake pipe and the flow path guide and in fluid communication with the intake pipe, wherein a diameter of the flow path guide is greater than a diameter of the intake guide.

7. The linear compressor of claim 6, further comprising:

a support spring comprising:

an inner portion connected to the intake guide, an outer portion connected to the back cover, and a connection portion that connects the inner portion to the outer portion, wherein the intake flow path member comprises an extension that extends radially outward from the rear surface of the intake flow path member, and wherein the outer portion of the support spring, the extension, and the back cover are coupled by a fastening member.

8. A linear compressor comprising:

a casing;

a back cover disposed in the casing;

an intake flow path member that is coupled to the back cover and has a front surface and a rear surface that are spaced apart from each other in an axial direction of the casing, the intake flow path member comprising a flow path guide that extends axially forward from the rear surface of the intake flow path member and has open ends; and an intake muffler configured to linearly reciprocate relative to the intake flow path member, at least a portion of the intake muffler being disposed inside the intake flow path member, wherein the intake flow path member defines a first hole at the front surface thereof, the first hole being configured to receive the intake muffler, and wherein the intake flow path member comprises a partition wall disposed rearward relative to the front surface of the intake flow path member, the partition wall defining a second hole configured to receive the intake muffler.

9. The linear compressor of claim 8, wherein a diameter of the second hole is less than a diameter of the first hole.

10. A linear compressor comprising:

a casing;

a back cover disposed in the casing;

an intake flow path member that is coupled to the back cover and has a front surface and a rear surface that are spaced apart from each other in an axial direction of the casing, the intake flow path member comprising a flow path guide that extends axially forward from the rear surface of the intake flow path member and has open ends; and an intake muffler configured to linearly reciprocate relative to the intake flow path member, at least a portion of the intake muffler being disposed inside the intake flow path member, wherein the intake flow path member defines a first hole at the front surface thereof, the first hole being configured to receive the intake muffler, and wherein the flow path guide has a rear end disposed axially rearward relative to the rear surface of the intake flow path member, the rear end of the flow path guide protruding to the back cover and passing through a central area of the back cover.

11. A linear compressor comprising:

a casing;

a back cover disposed in the casing;

an intake flow path member coupled to the back cover;

an intake muffler configured to linearly reciprocate relative to the intake flow path member, at least a portion of the intake muffler being disposed inside the intake flow path member;

a heat blocking member that is coupled to the back cover and extends radially outward relative to the back cover;

an intake pipe coupled to the casing and configured to suction a refrigerant from an outside of the casing;

an intake guide that is disposed between the heat blocking member and the intake pipe and in fluid communication with the intake pipe; and a support spring comprising:

an inner portion connected to the intake guide, an outer portion connected to the back cover, and a connection portion that connects the inner portion to the outer portion, wherein the heat blocking member defines a center hole at a central area thereof, wherein a diameter of the center hole is greater than a diameter of the intake guide, wherein the intake flow path member comprises an extension that extends radially outward from a rear surface of the intake flow path member, and wherein the outer portion of the support spring, the extension, the back cover, and the heat blocking member are coupled by a fastening member.

12. The linear compressor of claim 11, wherein an outer surface of the heat blocking member is disposed adjacent to an inner surface of the casing.

13. The linear compressor of claim 11, wherein the intake flow path member has a front surface and a rear surface that are spaced apart from each other in an axial direction of the casing, wherein the intake flow path member defines a first hole at the front surface thereof, the first hole being configured to receive the intake muffler, and wherein the intake flow path member comprises a flow path guide that protrudes axially forward from the rear surface of the intake flow path member, the flow path guide having a front opening that faces the intake muffler and a rear opening that faces the back cover.

14. A linear compressor comprising:

a casing;

a back cover disposed in the casing;

an intake flow path member coupled to the back cover;

an intake muffler configured to linearly reciprocate relative to the intake flow path member, at least a portion of the intake muffler being disposed inside the intake flow path member; and a heat blocking member that is coupled to the back cover and extends radially outward relative to the back cover, wherein the intake flow path member has a front surface and a rear surface that are spaced apart from each other in an axial direction of the casing, wherein the intake flow path member defines a first hole at the front surface thereof, the first hole being configured to receive the intake muffler, and wherein the intake flow path member comprises a flow path guide that protrudes axially rearward from a central area of the rear surface of the intake flow path member, the flow path guide having front and rear ends that are opened.

* * * * *